US009795814B2

(12) United States Patent
Yin

(10) Patent No.: US 9,795,814 B2
(45) Date of Patent: Oct. 24, 2017

(54) LIQUID PROJECTION BOMB, PROJECTING DEVICE AND DELIVERY METHOD THEREFOR

(71) Applicants: QINGDAO CREATE ENVIRONMENT CONTROL TECHNOLOGY CO., LTD., Qingdao, Shandong (CN); Xuejun Yin, Qingdao (CN)

(72) Inventor: Xuejun Yin, Qingdao (CN)

(73) Assignees: QINGDAO CREATE ENVIRONMENT CONTROL TECHNOLOGY CO., LTD., Qingdao, Shandong (CN); Xuejun Yin, Qingdao, Shandong (CN)

( * ) Notice: Subject to any disclaimer, the term of this patent is extended or adjusted under 35 U.S.C. 154(b) by 92 days.

(21) Appl. No.: 14/442,743

(22) PCT Filed: Nov. 14, 2013

(86) PCT No.: PCT/CN2013/087167
§ 371 (c)(1),
(2) Date: May 14, 2015

(87) PCT Pub. No.: WO2014/075621
PCT Pub. Date: May 22, 2014

(65) Prior Publication Data

US 2015/0314153 A1 Nov. 5, 2015

(30) Foreign Application Priority Data

Nov. 16, 2012 (CN) ..... 2012 1 0466226

(51) Int. Cl.
*A62C 2/00* (2006.01)
*A62C 31/00* (2006.01)
(Continued)

(52) U.S. Cl.
CPC ..... *A62C 31/00* (2013.01); *A62C 3/02* (2013.01); *A62C 3/025* (2013.01); *F41B 11/68* (2013.01);
(Continued)

(58) Field of Classification Search
CPC A62C 31/00; A62C 3/02; A62C 3/025; F41B 11/68; F41F 1/08; F42B 6/10; F42B 12/367; F42B 30/00
(Continued)

(56) References Cited

U.S. PATENT DOCUMENTS 2,665,768 A * 1/1954 Talbot ..... A62C 3/025 169/36
7,090,029 B2 * 8/2006 Cleary ..... A62C 3/025 169/36
(Continued)

FOREIGN PATENT DOCUMENTS

CN 2074652 U 4/1991
CN 2171383 Y 7/1994
(Continued)

OTHER PUBLICATIONS

PCT/ISA/210, "International Search Report for PCT/CN2013/087167," dated Jan. 23, 2014.
(Continued)

*Primary Examiner* — Steven J Ganey
(74) *Attorney, Agent, or Firm* — Manabu Kanesaka

(57) ABSTRACT

A liquid projection bomb includes a shell and is characterized in that functional liquid is filled into the shell, and the shell is made of a soft or hard material easy to crack when bumped. The functional liquid includes water, alcohol, fuel oil, and a solution of water mixed with an extinguishing agent, a fertilizer or a drug.

22 Claims, 13 Drawing Sheets

(51) Int. Cl.

| | |
|---|---|
| ***A62C 3/02*** | (2006.01) |
| ***F41F 1/08*** | (2006.01) |
| ***F42B 6/10*** | (2006.01) |
| ***F42B 12/36*** | (2006.01) |
| ***F42B 30/00*** | (2006.01) |
| ***F41B 11/68*** | (2013.01) |

(52) U.S. Cl.
CPC ..... *F41F 1/08* (2013.01); *F42B 6/10* (2013.01); *F42B 12/367* (2013.01); *F42B 30/00* (2013.01)

(58) Field of Classification Search
USPC ..... 169/35, 36, 28, 29, 54, 70, 46, 47; 102/370
See application file for complete search history.

(56) References Cited

U.S. PATENT DOCUMENTS

| | | | | |
|---|---|---|---|---|
| 7,823,510 | B1 | 11/2010 | Hobart et al. | |
| 2005/0056183 | A1 | 3/2005 | Meshirer | |
| 2010/0126740 | A1* | 5/2010 | Hartmann ..... | A62C 3/025 169/70 |

FOREIGN PATENT DOCUMENTS

| | | | |
|---|---|---|---|
| CN | 2193180 | Y | 3/1995 |
| CN | 2385303 | Y | 6/2000 |
| CN | 1314295 | A | 9/2001 |
| CN | 2628077 | Y | 7/2004 |
| CN | 1707217 | A | 12/2005 |
| CN | 1765432 | A | 5/2006 |
| CN | 2911601 | Y | 6/2007 |
| CN | 201145522 | Y | 11/2008 |
| CN | 201618340 | U | 11/2010 |
| CN | 201662369 | U | 12/2010 |
| CN | 201668907 | U | 12/2010 |
| CN | 201697565 | U | 1/2011 |
| CN | 102068779 | A | 5/2011 |
| CN | 102107049 | A | 6/2011 |
| CN | 202961596 | U | 6/2013 |
| JP | 2760968 | B2 | 6/1998 |
| KR | 20120006599 | A | 1/2012 |
| WO | 99/58202 | A2 | 11/1999 |

OTHER PUBLICATIONS

PCT/IB/373, "International Preliminary Report on Patentability for PCT/CN2013/087167," dated May 19, 2015.

China Patent Office, "First Office Action for CN 201210466226.1," dated Jun. 4, 2014.

China Patent Office, "Second Office Action for CN 201210466226.1," dated Jan. 13, 2015.

* cited by examiner

LIQUID PROJECTION BOMB, PROJECTING DEVICE AND DELIVERY METHOD THEREFOR

CROSS-REFERENCE TO RELATED APPLICATION

The present application is National Phase of International Application No. PCT/CN2013/087167 filed Nov. 14, 2013, and claims priority from Chinese Application No. CN201210466226.1 filed Nov. 16, 2012, the disclosure of which is incorporated herein.

TECHNICAL FIELD

The present invention relates to fire-fighting equipment, and particularly to a kind of equipment that can be used for extinguishing fire at high-rise buildings, dangerous scenes, grassland and forests, at a very long distance, and to a kind of ecology-preserving equipment, especially to equipment facilitating water and soil conservation and revegetation at an arid region, and specifically to a liquid projecting bomb, a projecting device and a delivery method therefor.

BACKGROUND

Recently, with the rapid growing of the national economy, people's daily life proposes higher level requirements to fire safety, particularly at places such as oil fields, oil depots, forests, grassland, and high-rise buildings, where fire fighters cannot get close once fire breaks out and becomes raging. Accordingly, fire-fighting devices that can be used at a long distance or with a long working range are in demand.

Due to the effect that in existing fire extinguishers, after water is jetted out of a pressurized nozzle by a pressurized water pump of existing fire trucks, water column will gradually be torn by air and then dispersedly fallen down to the ground, no matter how high the power of the water pump be enhanced to, jetting height that can be obtained is only up to about 80 meters. However, the high-rise buildings today usually are hundreds of meters high, and some are even with a height of two or three hundred meters, which is much higher than working range of any pressurized nozzles of the existing fire trucks. The pressurized nozzles cannot satisfy needs of current fire-fighting requirements any longer despite its working medium, for example, water, is readily available. Moreover, there are fire-fighting apparatuses in market, such as "rocket fire-extinguishing bombs", disclosed in CN2183551Y, which require loading fire-extinguishing agent into extinguishers and then discharging it to fire scene, by which extinguishing fire at a long distance can be implemented. Nevertheless, because of gunpowder, which is within this kind of equipment, and is classified as "flammables" that needs rigorous control and requires careful storage and transportation, and to be launched by specialized professionals, and furthermore because of a defect that the fire-fighting devices of this kind are also expensive, they are difficult to be used in high volume.

Aiming at the above-mentioned problems, technical solutions of delivering fire-extinguishing bombs with compressed air remotely, such as the "pneumatic fire-fighting gun" disclosed in CN2234285Y and the "bracket-type pneumatic fire-extinguishing gun" disclosed in CN1765432A, substantially improve safety of operation. Nevertheless, since most of these devices are equipped with single barrel and can only be operated manually, bomb projecting would be ineffective and the automation extent of the devices would be unsatisfactory. Furthermore, since the fire-extinguishing agents are still loading in the fire-extinguishing bombs, used as the fire-extinguishing medium, which require rigorous maintenance and would be out of service once get affected with damp or are expired. Furthermore, since the fire-extinguishing bombs are costly and the devices can only carry a limited number of fire-extinguishing bombs, it is not occasional that bombs are used up while fire is still burning, especially when conducting fieldwork. Therefore practicability of these devices is limited.

For the reasons set forth, extinguishing fire directly with water through existing fire fighting devices, remote delivery of water cannot be realized although using local resources would be readily available; existing fire-extinguishing bombs are costly, of limited loading capacity of bombs, and need maintenance and run risk of being ineffective due to its using fire-extinguishing agents as the fire-extinguishing medium, although they can be delivered much further. Meanwhile, existing remote fire-extinguishing devices cannot manufacture fire extinguishing bombs on site, it is in pressing need of a fire-extinguishing bomb and a projecting device that has a long working range, and is of large loading capacity of bombs without any limitations, and is cost efficient, more practicable, more automated, and easily applicable.

On the other hand, with the deterioration of global warming, soil erosion and impoverishment of many hills, uncultivated land, and grassland of arid regions are getting so severe that forests and grassland cannot be nourished and rain water cannot be absorbed and retained, which result in flood caused by rain and yellow, withered and bald plants caused by drought. Existing irrigation devices have at most a working distance of about 30 meters, they are unable to discharge water or fertilizer to further places. Otherwise, when delivering water manually, it would be drudging and perilous when no road is available or the route is dangerous. In aspect of insect extermination and sanitation, other than implementing aerial spraying by aircraft, there is neither device that is capable of providing forests and grassland with pesticides remotely (for example, delivery distance larger than 100 meters) nor device that is capable of providing forests and grassland with sanitation agents. For this reason, it is also in pressing need of ecology-preserving equipment for discharging water, liquid fertilizers, or liquid chemicals to further places, grassland, uncultivated land, desert, or hills, as well as a method therefor.

SUMMARY

In order to overcome foregoing deficiencies, one of objects of the present invention is to provide a liquid projecting bomb that can draw on local resources and be applicable to remote delivery.

The liquid projecting bomb of the present invention comprises a shell, wherein a functional liquid is filled into the shell, and the shell is made of a soft or hard material that is prone to crack when bumped.

The soft material that is easy to crack when bumped comprises plastic membranes, foils, papers, or composites that are made of at least two of the above-mentioned materials. The hard materials that are easy to crack when bumped comprise cardboard, plastics, or composites made of the two.

The functional liquid comprises water, alcohol, fuel oil, and mixed solution of water and extinguishing agents, fertilizers, or pesticides. Water could be water on the ground or water underground, which include common surface water bodies, such as creeks, rivers, lakes, seas, ponds and reservoirs, or water bodies that are drawn underground, such as well water, water supply, and water for fire-fighting purpose.

Preferably, the soft or hard material, which constitutes the shell and is easy to crack when bumped, is fire-retardant, or treated with fire-retardant. The fire-retardant treatment can be implemented in a variety of ways, such as fire-retardant layers arranged on the surface of the shell formed by using processing of adhering and coating and so on, or presoaking the shell with fire-retardant liquid. Additionally, for the purpose of environmental protection, preferably, the soft or hard material can be an environment-friendly material that is capable of degrading naturally and rapidly.

In order for remote delivery and preventing the tail of the shell from damaging by force, it is possible to provide a propelling mount on the shell. Moreover, in order to ensure the liquid projecting bombs of the present application a stable flying with a least drag, it is possible to provide the shell with a stabilizer wing and/or a fairing. The fairing is arranged at the front of the shell, whereas the stabilizer wing is arranged at the tail or the middle and rear portions, the stabilizer wing being foldable when it is arranged at the middle and rear portions. Due to the placement of the stabilizer wing, it does not matter whether the liquid projecting bomb along its longitudinal axis rotates or not during the flying after the liquid projecting bomb is projected. For the liquid projecting bomb that rotates during flying after being projected, it is possible to arrange two chambers longitudinally within the shell, continuously or separately, to ensure liquid inside the liquid projecting bomb rotating with the shell so as to keep a stable flying posture. In addition, it is also possible to arrange a shell-cracking trigger on or within the shell, to ensure cracking of the shell by which the functional liquid inside disperses, when the liquid projecting bomb is delivered to target place. The shell-cracking trigger can be a brittle or sharp means arranged on or within the shell. It is also possible for the shell-cracking trigger to be at least one weaken zone arranged on the shell.

It is also possible to provide on at least partial surface of the shell with a propelling casing for the liquid projecting bomb of the present invention. When in use, the placement of the propelling casing could be set in various ways, such as at the bottom and partially on the sides of the shell, or at the bottom and on all the sides of the shell, selection depending on practical needs.

Outer surface of the shell or the propelling casing could be provided with a drag-reduction and abrasion-resistance layer. The drag-reduction and abrasion-resistance layer is made of low friction coefficient materials, such as Teflon and so on. Moreover, the outer surface of the shell or the propelling casing could be provided with a pressure-balancing channel. The pressure-balancing channel is provided with an opening open towards the tail of the shell. Due to the pressure-balancing channel added on the outer surface of the shell or propelling casing, when the liquid projecting bomb is loaded into a projecting barrel, the pressure-balancing channel and the wall of the barrel form an air chamber that is in communication with a projecting chamber. When the liquid projecting bomb is moving along the projecting chamber under pneumatic pressure, the air chamber decreases contact area between the liquid projecting bomb and the wall of the projecting barrel, and air within the air chamber further provides lubrication, which effectively prevents dispersal of the functional liquid inside the shell prematurely due to inadvertently damaging of the liquid projecting bomb ahead of time.

The second object of the present invention is to provide a projecting device applying the liquid projecting bombs described above. The projecting device comprises a compressed air source, a projecting switch, and a projecting barrel, the projecting barrel being provided with a projecting chamber at the tail, wherein it further comprises a functional liquid source, a bomb-packaging device, a bomb storage, and an accumulator-regulating tank, the functional liquid source providing a functional liquid, the bomb-packaging device packaging functional liquid from the functional liquid source into a liquid projecting bomb, the packed liquid projecting bomb being placed in the bomb storage, the accumulator-regulating tank being provided with a pressure regulator, the accumulator-regulating tank being in communication with the projecting chamber via the projecting switch.

In order to increase efficiency of projecting, number of the projecting barrel could be more than one. The projecting barrels are arranged side by side in one row, in two rows, or in more than two rows, constituting projecting barrel groups. The projecting barrels are divided into at least two groups, each group including at least one projecting barrel. Each group of the projecting barrels shares a projecting switch, and a delay switch-on mechanism is provided between the projecting switches, each projecting switch being provided with an automatically switch-off mechanism. Previous one of the automatically switch-off mechanisms coordinates with next one of the delay switch-on mechanisms, so that those groups could project successively and that the problems of frequent pressurization due to excessive consumption of the accumulator-regulating tank and liquid projecting bomb deviation from target due to instable pressure are prevented when multiple groups of projecting barrels project simultaneously. Also, the recoil effect resulted from projecting on the projecting device of the present invention is alleviated. In order to prevent damaging of the liquid projecting bomb within the projecting barrel, a propelling mount barrel can be provided within the projecting chamber of each of projecting barrels constituting the projecting group, in which projecting chamber the liquid projecting bomb is filled when projecting. A propelling mount barrel restoring mechanism is further provided within the projecting barrel. Moreover, referring to bomb-loading mechanism of existing bomb, the bomb-loading device of the present invention employs any one of top loading, side loading, rotary loading, or rear loading mechanism. It is also possible to arrange at the front of the projecting barrel a sensing and actuating mechanism which senses bombs leaving the barrel and actuates when sensing the bombs. The projecting switch is provided with an automatically switch-off mechanism. The sensing and actuating mechanism that includes a photoelectric sensor or a pressure sensor, triggers the automatically switch-off mechanism to switch off the projecting switch, and/or triggers the bomb-loading device to open the projecting chamber.

Since the shell of the liquid projecting bomb that is applied by the projecting device of the present invention is made of materials that is easy to crack when bumped, in order to prevent scraping of the shell due to roughness of side wall of the projecting barrel during the liquid projecting bomb is projecting, it is possible to provide within the projecting barrel a sleeve or a coating made of low friction coefficient materials. The low friction coefficient materials can be selected from a group including nylon, PVC, fluorinated graphene, Teflon, or metallic materials that could be used in electroplating. The metallic materials can be selected from a group including zinc, nickel, chromium and the like.

For the same considerations, when inner surface of the projecting barrel is provided with a smoothbore channel that spirals gradually, tall surface of the smoothbore channel, weather concave or convex, should be a smooth and rounded surface.

Furthermore, in order to prevent damage of the shell results from a large deformation due to a rapid change in pressure at the moment of projecting of the liquid projecting bomb, it is possible to provide on the projecting barrel a pressure-relief device to adjust the pressure changes when the liquid projecting bomb leaves the barrel. The pressure-relief device could be a pressure-relief device in any form. For example, the pressure-relief device could be a pressure-relief valve on the projecting barrel, or an enlarged section with a lumen near outlet of the projecting barrel, diameter of which lumen increase gradually from inner end to outer end; or a pressure-relief section with barrel wall near the outlet of the projecting barrel, on which barrel wall a plurality of pressure-relief holes is arranged, length of the pressure-relief section being longer than that of the liquid projecting bomb.

The bomb-packaging device comprises a feeding tube, a metering device, a feeding switch, a shell holding device, a shell-opening device, and a shell-closing device. Also, the bomb-packaging device can further comprise a vacuum-sorbing device.

Since the projecting device comprises the functional liquid source, the liquid projecting bombs can be produced at any time n a large scale utilizing the bomb-packaging device. In particular, since the liquid projecting bombs can be produced with materials obtained locally and easily, and be produced nearby a place having water, transportation would be eliminated, which is particularly suitable for large volume projecting in field. In order to better realize purpose of large volume projecting, the projecting device of the invention is provided with a compressed air source, which is in communication with the accumulator-regulating tank. A pressure-regulating device is provided between the accumulator-regulating tank and the compressed air source. The pressure-regulating device comprises a pressure-regulating valve and a pressure sensor in communication with the accumulator-regulating tank, the pressure valve comprising three functional valves or three valve statuses: switching off, depressurizing, and pressurizing. After detection by the pressure sensor, the pressure-regulating valve automatically switches off when pressure inside the accumulator-regulating tank meets a requirement. The pressure-regulating valve connects the accumulator-regulating tank to the atmosphere to perform pressure reducing when needed, and connects the accumulator-regulating tank to the compressed air source to perform pressure boosting when needed.

In order to improve accuracy of projecting, the projecting barrel is also provided with a sighting system. The sighting system comprises at least one of laser rangefinder, optical sight, elevation angle measurement device, and rotational angle measurement device. Also, an angle-regulating device and/or an elevation-regulating device are included. The sighting system further comprises meteorological sensing system and a trajectory calculation system, the meteorological sensing system including at least one of anemometer, anemoscope, barometer, and thermometer. Measurement results of the meteorological sensing system are input into the trajectory calculation system to calculate projecting pressure and sighting parameters of the projecting barrel groups. In order to further improve accuracy of projecting, the projecting device can further comprise a manual correction device or an automatic correction device for impact point.

In order to improve mobility and to make sighting easier, the projecting device of the invention can also comprise a rotary chassis, a fixed chassis, and a truck. The rotary chassis rotates relative to the fixed chassis. At least the bomb-loading device, the projecting barrel, and the accumulator-regulating tank are placed on the rotary chassis. The fixed chassis is fixed to the truck. They altogether constitute a projecting truck. The projecting truck is provided with hydraulic stabilizing legs. Furthermore, it is also possible to place the functional liquid source, the bomb-packaging device and the bomb storage on another truck, all of which constitute a bomb-packaging truck, which is capable of packaging bombs distantly at a functional liquid source (for example, a pond), and cooperating with the projecting truck to store the packed liquid projecting bombs on the bomb-packing device within the bomb storage and feed the bombs to the projecting truck for projecting, which is advantageous in further improving the capacity of production and supply of the bombs and the capacity of remote delivery.

The functional liquid source of the invention could be a liquid storage tank and/or a liquid transportation pump. Depending on various applications, it sometimes needs to mix some additives, such as fire-extinguishing agents, fertilizers, or pesticides into water inside the liquid storage tank before producing the liquid projecting bombs with the projecting device of the invention. For mixing the additives evenly, it is also possible to provide the liquid storage tank with a stirring device.

The third object of the invention is to provide a method for delivering the liquid projecting bomb using said projecting device, the method being wherein it comprises the following steps:

1) Packaging the functional liquid from the functional liquid source in the shell with the bomb-packaging device to manufacture the liquid projecting bombs;
2) storing the liquid projecting bombs in the bomb storage;
3) stably placing the projecting device near the target according to its working range;
4) loading the liquid projecting bombs in the storage into the projecting chamber of the projecting barrel with the bomb-loading device, closing the projecting chamber;
5) determining projecting parameters, and aiming at the target;
6) fine-tuning pressure in the accumulator-regulating tank with the pressure-regulating device according to the projecting parameters, so that the pressure in the accumulator-regulating tank reaches a set projecting pressure;
7) switching on the projecting switch so that the accumulator-regulating tank and the projecting chamber are put in communication with each other, and that the compressed air in the accumulator-regulating tank enters into the projecting chamber to push the liquid projecting bombs in the projecting chamber out of the projecting barrel, then switching off the projecting switch at the moment when the liquid projecting bomb is about to be projected out of the projecting barrel;
8) correcting horizontal angle, elevation angle, or projecting pressure of the projecting barrel during projecting according to actual impact point;

9) reloading the liquid projecting bombs for the next round of projecting into the projecting barrel with the bomb-loading device to undertake the next round of projecting.

In using the method of the present invention for delivering the liquid projecting bombs, when there are more than one projecting barrels in the projecting device, delay switch-on mechanisms and automatically switch-off mechanisms of various projecting switches of various projecting barrel groups corporate with each other to accomplish each one of the various projecting barrel groups projecting the liquid projecting bombs successively.

The liquid projecting bomb of the invention mainly employs water that is readily accessible as the functional liquid, so as to obtain materials from local resources easily. It is also cost effective and economically reliable, with good practicability and adaptability and without any risks of being ineffective due to expiration. Also, depending on various applications, it is possible to mix fire-extinguishing agents, fertilizers, or pesticides into water, further expanding functions of the liquid projecting bombs of the invention.

The projecting device of the present invention employs compressed air as power source, thus a safe remote delivery can be realized. Particularly due to the bomb-packaging device in the projecting device of the invention, manufacture and projecting of the liquid projecting bombs can be realized with advantages of being safe, efficient, environmental-friendly, and being capable of use in high volume. Practicability and adaptability are substantially improved. The method for projecting the liquid projecting bombs with the projecting device of the present invention is convenient and safe, and can be operated conveniently.

The functional liquid in the liquid projecting bombs is mainly water. Thus, based on the delivering method utilizing projecting devices of the present invention, not only fire-fighting for high-rise buildings, forests, or oil fields that requires long distance or remote fire extinguishing can be implemented, but also many other functions can be realized. For example, it can be used in ecological restoration of desertified area or alleviation of drought occurred in wasteland or grassland. Specifically, just directly projecting the liquid projecting bombs of the invention to wasteland, grassland, or desertified area would be sufficiently helpful. It can also be used as means to expel people in occurrences that maintenance of order is needed, such as illegal protest, looting, or street fighting. When a ship is provided with the projecting device of the present invention, it can function to extinguish fires at ships, offshore platforms, or onshore facilities. Certainly, it can also be used to expel pirates, or ships that enter territorial sea illegally as a general enforcement means. Also, it can be further used in extermination of disease and insect pest in forests or grassland, or in fertilizing for grass and plants. Depending on different objects to be realized, the functional liquid in the liquid projecting bombs can be a solution mixed with fire-extinguishing agents, fertilizers, or pesticides, so as to better solve a specific need. Besides, the liquid projecting bomb of the invention can be filled with other functional liquids such as alcohol or fuel to realize various functions. For example, delivery of the liquid projecting bombs filled with alcohol can be used to remote disinfect work. Certainly the liquid projecting bombs can be filled with a solution mixed with drugs to realize epidemic prevention. Liquid projecting bombs that filled with fuel as the functional liquid can be used in land reclamation so as to accomplish safe and quick reclaiming of wasteland.

At the beginning of research of the invention, it is a prevalent belief among persons of the art that if the shell of the liquid projecting bomb is thick, then the shell would not crack on impact and the expected function cannot be realized, and that if the shell of the liquid projecting bomb is thin, the shell is easy to cracking after being projected, while the shell would be also easy to crack in the projecting barrel during projecting phase. This is because the fact that the projecting pressure of the projecting device of the invention is usually between 0.3-1.0 MPa, i.e. 3-10 atm, for a longer working range. Theoretically, a liquid projecting bomb with a diameter of 120 mm and a length of 600 mm and a weight of 4.0 kilograms would withstand a thrust of about 670 kilograms. Apparently, the shell cannot withstand such a high thrust, and it is impossible to have the shell not crack in the projecting barrel but easy to crack upon landing. With a plurality of experiments, and by taking some measures such as using the shell made of hard material, adding a propelling mount at the bottom of the shell, or providing a propelling mount in the projecting barrel, damage of the liquid projecting bomb in the projecting barrel can be prevented effectively. Finally, after scrutinizing the results and repeated trials, it is possible to prevent damage of the liquid projecting bomb in the projecting barrel after the bomb is projected even if the shell is thin and is made of soft materials. The principle is that in propelling phase, although the thrust is high, up to hundreds of kilograms, the projecting thrust of the liquid projecting bomb in axial direction is in balance with the counteracting inertia force of the liquid projecting bomb, and inside pressure at the bottom of the shell is in balance with outside pressure; the side of the shell is supported by the inner surface of the projecting barrel, if the later is smooth, the shell would not crack; at the front of the liquid projecting bomb, pressure from the counteracting inertia force is in rearward and radial direction, inside pressure and outside pressure of the soft shell in forward-rearward direction are substantially in balance, leaves only pressure unbalanced in radial direction but not significant in magnitude. In conclusion, during projecting, the projecting pressure of 3-10 atm is not completely endured by the shell of the liquid projecting bomb, thus the liquid projecting bomb is not easy to breakage. However, since the pressure in forward-rearward direction of the liquid projecting bomb is suddenly out of balance at the moment when the bomb leaves the outlet of the projecting barrel, the shell is easy to crack, and thus a special measure is needed to control this problem. This is also the reason why providing the projecting barrel of the projecting device of the invention with a pressure-relief device.

To sum up, the liquid projecting bomb of the present invention and its projecting device are cost effective, practical, and convenient. The method of the present invention for delivering the liquid projecting bomb with the projecting device is easy and efficient, thus its market prospect is broad.

DESCRIPTION OF THE PREFERRED EMBODIMENTS

The First Embodiment

Figure 1:
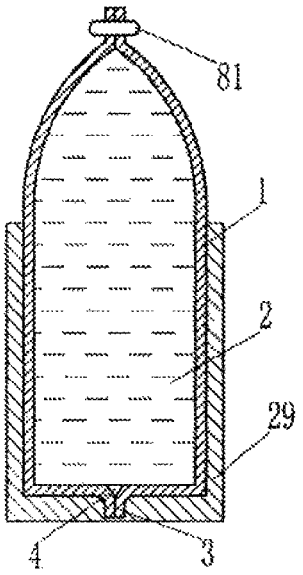
FIG. 1 is a first structural illustration of the liquid projecting bomb of the invention.
Figure 2:
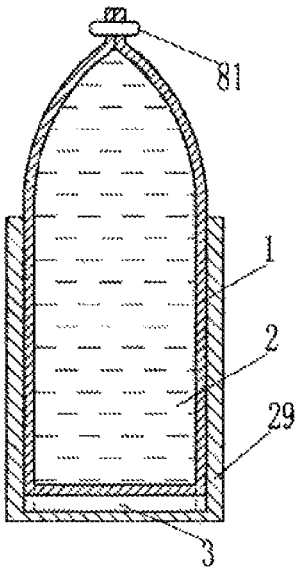
FIG. 2 is a left view of FIG. 1.

The liquid projecting bomb of the invention shown in FIGS. 1 and 2 comprises a shell 1; the shell 1 is made of a plastic membrane. Functional liquid is filled into the shell 1; the functional liquid is water 2. The front end of the shell 1 is sealed with a metallic clip 81, whereas the tail of the shell 1 is provided with a feeding channel 4. The feeding channel 4 is close to the tail of the shell 1 and will be heat-sealed with a sealer 3 to ensure the water 2 within the shell 1 would not leak out. Also, to facilitate remote delivery and to prevent rear portion of the shell 1 of the liquid projecting bomb of the invention from damage due to force endured during projecting of the bomb, the tail of the shell 1 is further provided with a propelling mount 29.

It should be noted that the shell 1 of the liquid projecting bomb is thin and is made of a soft plastic membrane, therefore, the sealer 3 would be deflected to conform to the profile of the bottom of the shell after the bomb is mated with the propelling mount 29, and would not take up much room within the propelling mount 29. Also, in fact, thickness of the wall of the propelling mount 29 is thin. The thickness of the wall of the shell 1 and the propelling mount 29, and the actual mating status between the sealer 3 and the propelling mount 29 in FIGS. 1 and 2 are illustrative only for purpose of representation and explanation of structure of each portion of the liquid projecting bomb, unless noted otherwise.

Manufacture and delivery of the liquid projecting bomb of the invention is realized by the projecting device. The projecting device shown in FIGS. 3, 4, 5 and 6 comprises a compressed air source 50, a projecting switch 7, and a plurality of projecting barrels 8. The projecting barrels 8 are arranged in 3 rows and 4 columns. They are supported by a frame 16 and constitute projecting barrel groups. A pressure-relief device is provided on each of the projecting barrels 8 in form of a pressure-relief section arranged near outlet of the projecting barrel 8. A plurality of pressure-relief holes 84 is provided in the wall of the projecting barrels. Length of the pressure-relief section is longer than that of the liquid projecting bomb, and transitions between the pressure-relief holes and inner wall of the projecting barrel are smooth. The tail of the projecting barrel 8 is provided with a projecting chamber 25. A sighting system is also provided on the projecting barrel 8. The projecting device further comprises a functional liquid source consisting of a liquid storage tank 9, a bomb-packaging device 10, a bomb storage 11, a bomb-loading device 12, and an accumulator-regulating tank 5. The functional water, i.e. water is filled into the liquid storage tank 9. The bomb-packaging device 10 packs the functional liquid in the liquid storage tank into the liquid projecting bombs. The packed liquid projecting bombs are stored in the bomb storage 11 that is in communication with the bomb-loading device 12. The accumulator-regulating tank 5 is in communication with the projecting chamber 25 through a tube 27 and a projecting switch 7. The accumulator-regulating tank 5 is provided with a pressure-regulating device 6, the pressure-regulating device 6 being arranged between the compressed air source 50 and the accumulator-regulating tank 5. In order to satisfy need of large volume delivery, the compressed air source 50 is a high-power air compressor. The sighting system comprises a sighting device (not shown) and an elevation-regulating mechanism. The elevation-regulating mechanism comprises a rear supporting leg 13 that is arranged below the frame 16 and with a fixed length. Moreover, it could also have a front supporting leg, the overall height of which can be adjusted with a screw 14 and a support 15. Each projecting barrel 8 is provided with a corresponding projecting switch 7 for control. Furthermore, each projecting switch 7 is provided with an automatically switch-off mechanism. The principle of time setting of the projecting switch is that the projecting switch switches off when the front end of the liquid projecting bomb is leaving the projecting barrel. A delay switch-on mechanism is arranged between adjacent projecting switches 7. The previous one of the automatically switch-off mechanism coordinates with the next one of the delay switch-on mechanisms, so that those groups could delivery liquid projecting bombs successively through cooperation of the delay switch-on mechanisms and the automatically switch-off mechanisms of various projecting switches. Since electromagnetic valves capable of automatically switching on and off and delay control are fairly common in the prior art, structure of the projecting switches will not be described in detail.

It should be noted that in the liquid projecting bomb of the invention, the propelling mount 29 which is in a cylindrical shape, is provided surround the tail of the shell. In order to ensure no pressure relief occurs in the projecting barrel during projecting, on one hand, outer diameter of the propelling mount 29 should correspond to inner diameter of the propelling barrel, and on the other hand, the propelling mount 29 is preferably made of a material with some elasticity, such as elastic polyurethane, elastic rubber, and the like so as to form a seal with the side wall of the projecting barrel. The propelling mount 29 should be harder than the shell of the liquid projecting bomb. Also, the tube 27 in the figure is drawn thinner for clear. However, the diameter of the tube 27 is very large in order to provide enough thrust in practical applications.

The pressure-regulating device 6 comprises a pressure-regulating valve and a pressure sensor (not shown) that are in communication with the accumulator-regulating tank 5, the pressure-regulating valve including three valve statuses: switching off, depressurization, and pressurization. After an output pressure of the accumulator-regulating tank 5 is determined according to a working range, the pressure-regulating device 6 then finely tunes the air pressure in the accumulator-regulating tank 5, with the following steps: when the pressure inside the accumulator-regulating tank 5 detected by the pressure sensor satisfies a requirement, the pressure-regulating valve in the pressure-regulating device 6 automatically switches off; when depressurization is needed, the pressure-regulating valve connects the accumulator-regulating tank 5 with atmosphere for pressure relief; when pressurization is needed, the pressure-regulating valve connects the accumulator-regulating tank 5 with the compressed air source 50 for pressurization. For sure, based on the above principle, the pressure-regulating valve in the pressure-regulating device 6 can also be a combination of the three functional valves, i.e. switching off valve, depressurization valve, and pressurization valve, which can realize the same effect. Also, it should be noted that, as a special case, since high-power air compressors of some high-end brands have incorporated a high-capacity airbag and a pressure stabilizing system (for example, Ingersoll Rand's large air compressors), if such air compressors are used as the compressed air source 50 of the invention, it is possible not to provide additional pressure-regulating device 6 and accumulator-regulating tank 5. This kind of air compressors can be regarded as an integrated device of the pressure-regulating device 6, the accumulator-regulating tank 5, and the compressed air source 50. The above description is applicable to any one of solutions of the projecting device of the invention.

It should be noted that the pressure-relief section is provided on a portion of the wall of the projecting barrel 8 near an outlet end. When the front of the liquid projecting bomb arrives at the outlet end of the projecting barrel, at least some of the pressure-relief holes 84 have been in communication with the outside, and by this way the pressure in the projecting barrel could be gradually reduced. When the front of the liquid projecting bomb leaves the projecting barrel, the shell of the liquid projecting bomb is capable of withstanding the relieved pressure inside the projecting barrel. By providing the projecting barrel with the pressure-relief section, the problem that the shell is easy to damage due to a huge pressure difference between the tail withstanding a high thrust pressure and the front only withstanding the atmosphere pressure when part of the liquid projecting bomb leaving the projecting barrel is prevented. In order to fulfill this purpose, when setting pressure-relief holes, the length of the pressure-relief section of the projecting barrel should be longer than the length of the liquid projecting bomb.

Figure 5:
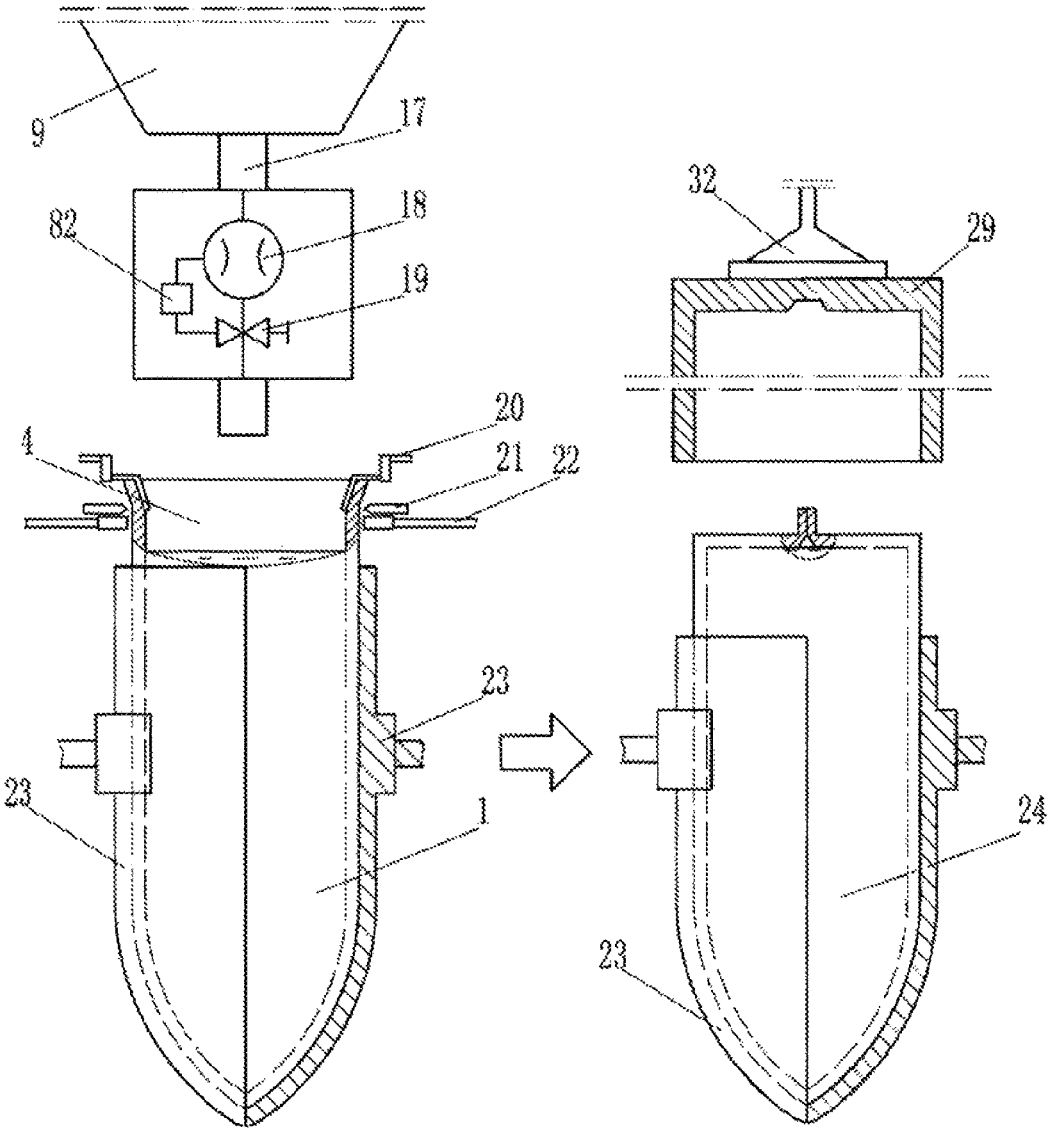
FIG. 5 is a first structural illustration and its working mechanism illustration of the bomb-packaging device of the projecting device of the invention.

Following is a description of the process of manufacturing the liquid projecting bomb by the projecting device of the invention, with reference to FIG. 5. Water that is used as the functional liquid is stored within the liquid storage tank 9. When the liquid projecting bomb needs to be manufactured, the bomb-packaging device of the projecting device of the invention starts to work. The bomb-packaging device comprises a feeding tube 17, a metering device, a feeding switch 19, a shell holding device 23, a shell-opening device 20, a shell-closing device, and a vacuum-sorbing device 32. The metering device consists of a flow controller 18, a signal control device 82, and a feeding switch 19. The shell-closing device consists of a heat-sealing device 22 and a cutting device 21. The heat-sealing device works under the same working mechanism as existing heat-sealing devices. The working mechanism of the bomb-packaging device is as follows: first, sending a semi-finished shell that is sealed by the metallic clip at one end to a filling station; the shell-opening device 20 opens the feeding channel 4 of the shell 1; blowing air through blowing holes arranged in the shell-opening device into the inner chamber of the shell to make it open, and at the same time, the shell holding device 23 holds externally the whole shell expanded by air; then, the water within the liquid storage tank 9 enters into the bomb-packaging device through the feeding tube 17; after being metered by the metering device, the water enters the shell 1 through the feeding channel 4; when volume of the water flowing through the flow controller 18 reaches a determined value, the shell 1 is full of the water, the signal control device 82 is actuated, and the feeding switch 19 is turned off, to stop filling the shell 1 with water; then the heat-sealing device 22 is actuated to seal the feeding channel 4, and the cutting device 21 cuts away the rest part of the shell, thus a semi-finished liquid projecting bomb 24 is produced; the shell holding device 23 holds the semi-finished liquid projecting bomb and sends it to the next station where the vacuum-sorbing device 32 is provided; the propelling mount 29 is sent to and mated with the tail of the semi-finished liquid projecting bomb by the vacuum-sorbing device 32, then the liquid projecting bomb of the invention is finished; the finished liquid projecting bomb is put into the bomb storage, and then repeat this method to manufacture the next liquid projecting bomb.

It should be noted that, in practical applications, other than manufacturing the liquid projecting bomb with a semi-finished shell that is fastened by the metallic clip at one end, it is also possible to set an additional station to use the metallic clip to implement the fastening action in order to manufacture the semi-finished shell, and thus plastic membrane tubular strip can be used in a continuous manufacturing, as long as after the feeding channel of the previous liquid projecting bomb is sealed by the heat-sealing device 22, fastened by the metallic clip above the portion sealed and the cutting device 21 cut off the part between the sealed part and the position where the metallic clip is fastened. By this way, the semi-finished liquid projecting bomb that is filled with the functional liquid is moved toward the next station and the following plastic membrane strip that is fastened by the metallic clip is brought to the filling station, cooperating with the shell holding device 23 and the shell-opening device 20 to perform the functional liquid filling work. Since the working mechanism of this procedure is similar to that of existing automatic packaging machines used for ham and liquid food that are stored in bags, detailed explanation is omitted here, both of which are within the claimed protection scope of the invention. Certainly, the liquid projecting bomb of the invention can also take a form of being fastened by the metallic clips at both ends, and this is also within the claimed protection scope of the invention.

Figure 3:
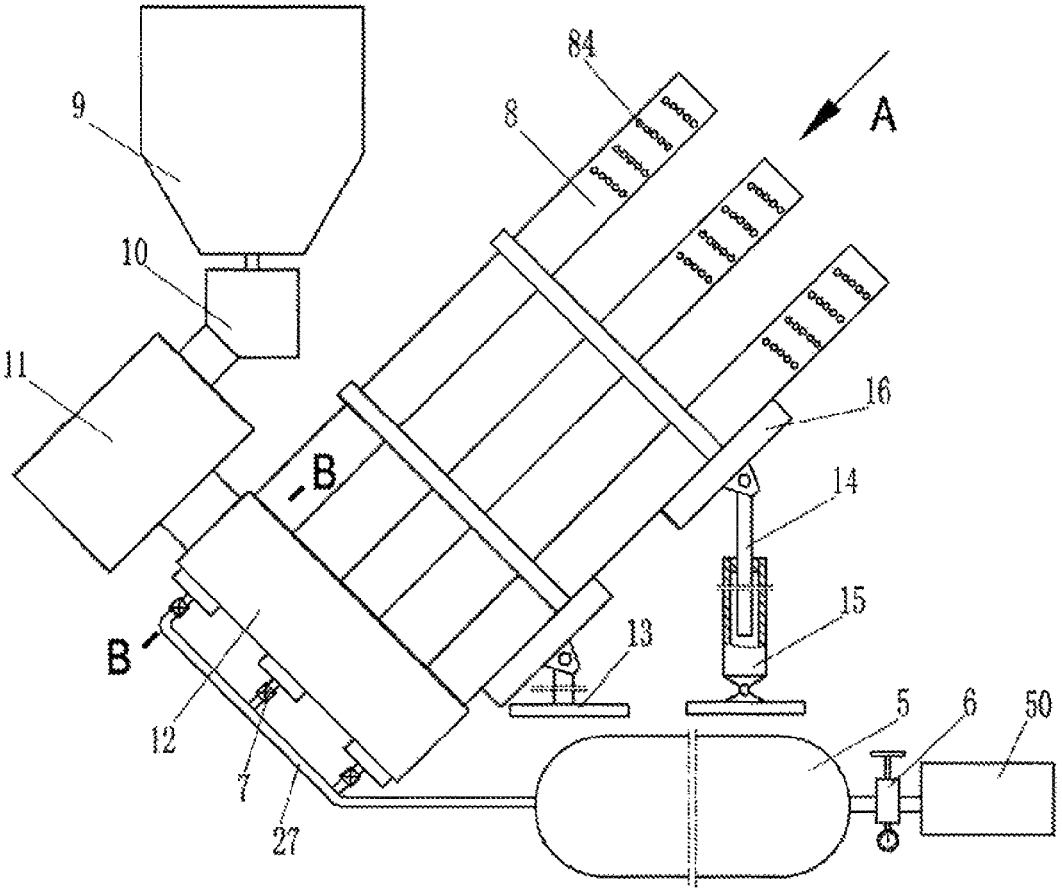
FIG. 3 is a first structural illustration of the projecting device of the invention.
Figure 4:
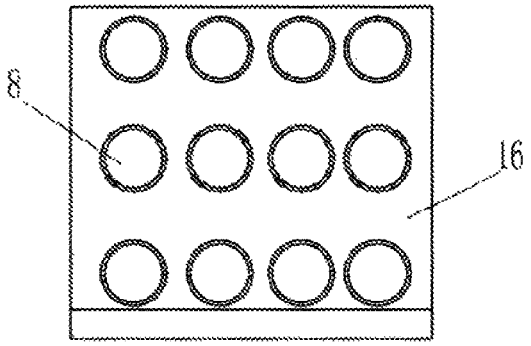
FIG. 4 is a view of FIG. 3 taken in direction of A.
Figure 6:
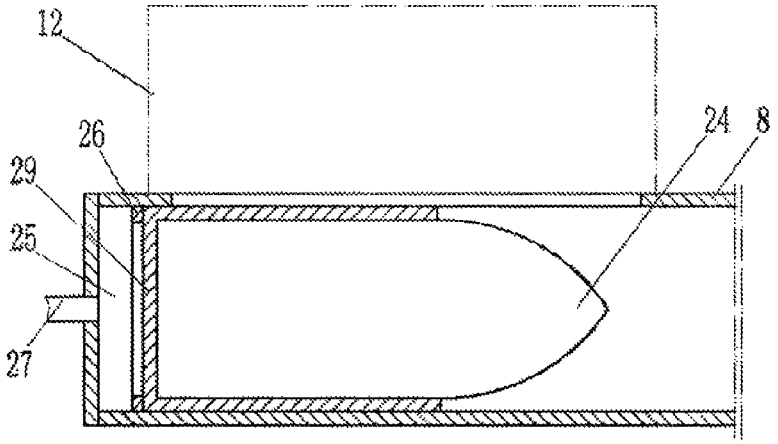
FIG. 6 is a first sectional view of FIG. 3 taken along a line of B-B.

Following is a description of process according to the method of delivering the liquid projecting bomb with the projecting device, with reference to FIGS. 1-6: (1) using the bomb-packaging device to pack water that is a readily accessible functional liquid into the shell 1 in order to make the liquid projecting bomb 24; (2) storing the finished liquid projecting bomb 24 in the bomb storage 11 of the projecting device; (3) determining a target, stably placing the projecting device near the target according to its working range; (4) using the bomb-loading device 12 to load the liquid projecting bombs 24 in the bomb storage 11 into the projecting chamber of each projecting barrel 8 and then close the projecting chamber; the liquid projecting bomb 24 is located under the projecting chamber with the help of a limit ring and keeps at a distance from a terminal end surface of the projecting chamber, as shown in FIG. 6; (5) aiming at the target using the sighting system and determining projecting parameters; (6) in accordance with the parameters, using the pressure-regulating device 6 to finely tune the pressure in the accumulator-regulating tank 5, so that the pressure in the accumulator-regulating tank 5 reaches the predetermined value; (7) as shown in FIGS. 3 and 6, switching on the projecting switch 7 corresponding to the first projecting barrel 8, so that the accumulator-regulating tank 5 is in communication with the projecting chamber 25 of the first projecting barrel 8 and that air of high pressure enters into the projecting chamber of the first projecting barrel, pushing the liquid projecting bomb in the projecting chamber out of the projecting barrel 8; when the tail of the liquid projecting bomb enters the pressure-relief section, the projecting switch 7 corresponding to the first projecting barrel 8 switches off and the projecting switch corresponding to the second projecting barrel 8 switches on; the rest of the liquid projecting bombs in the projecting barrel 8 are projected out sequentially according to the preceding process, and when the bombs arrives at the target and drops on the land, the bombs crack and the functional liquid inside disperses on a large area; (8) correcting a horizontal angle, an elevation angle, and projecting pressure of the projecting barrel 8 according to a impact point during projecting; (9) using the bomb-loading device 12 to load the next group of the liquid projecting bombs 24 into each projecting barrel 8 and initiating another round of projecting.

Due to addition of the propelling mount 29 to the shell of the liquid projecting bomb, there would be less inadvertent damages, better delivery effects, higher efficiency, and better practicability during delivering of the liquid projecting bomb. It should be noted that the shell of the liquid projecting bombs in the invention could be made of soft or hard materials that is easy to crack when bumped. In addition to the mentioned plastic membrane, the soft material further includes paper, foil, or a composite made of at least two of the paper, the foil, and the plastic membrane. All these materials can be used to manufacture the shell, and they can reach the same effect as long as the shell cracks when being collided. Furthermore, the ways to load bombs for the bomb-loading device 12 of the invention could be top pressing in, side pressing in, rotary pressing, or rear pressing in. Existing bomb-loading devices have similar ways, so these ways are not described in detail.

The liquid projecting bomb of the invention employs water that could be easily obtained from local resources and takes no risk of being ineffective due to expiration and is cost effective, economically reliable as the functional fluid. The projecting device of the invention uses compressed air as a power source, remote delivery can be safely realized. Particularly, because of the existence of the bomb-packaging device of the projecting device of the invention, manufacture and delivery of the liquid projecting bombs can be implemented in one process with advantages of safety, high efficiency, environmental-friendly, and high projecting volume, so that its practicability and adaptability are substantially improved. The method for delivering the liquid projecting bombs with the projecting device of the present invention is easy and convenient. Since the liquid projecting bomb of the invention uses water as the functional liquid and the shell is made of soft or hard materials that is easy to crack when bumped, once it impacts on the ground or any objects on the ground, the shell cracks instantaneously and the water inside the shell disperses. More importantly, a general water hydrant employs a principle of ejecting water and a water column will be torn to be atomized during flying by air, and accordingly drops down to the ground ahead of time. Therefore its working range is 150 meters far and 80 meters high at maximum. As a contrast, since the functional liquid of the invention is enclosed in the shell, atomization of the functional liquid is prevented, other than air drag loss, the liquid projecting bomb substantially follows a parabola movement before it reaches to the target, its working range can be 200-500 meters high, which satisfies fire-extinguishing requirement for high-rise buildings and skyscrapers, and 800-2000 meters far, which realizes fire-extinguishing at a long distance. Therefore, the present invention is revolutionary. The further the working range, the better a protection measure is needed. For example, a propelling mount barrel can be provided within the projecting barrel, or a propelling mount, a fairing, a stabilizer and the like can be provided on the liquid projecting bomb, to prevent the liquid projecting bomb from cracking in the projecting barrel or during flying after being projected. Therefore, based on said method, using the projecting device of the invention to deliver the liquid projecting bombs can realize not only high or far fire extinguishing in high-rise buildings, forests, and oil fields and so on, but also many other functions. For example, it can also be used to ecological restoration of desertified area or alleviation of drought occurred in wasteland or grassland. Specifically, just directly delivering the liquid projecting bombs of the invention to wasteland, grassland, or desertified area would be sufficiently helpful. Moreover, it can be further used in pests control of forests or grassland, or in fertilizing, or in epidemic prevention. Based on different objects aimed, the functional liquid in the liquid projecting bombs could be solution of mixture of water with fire-extinguishing agents, fertilizers, or pesticides, and then the liquid projecting bombs filled with such solution are delivered directly to the target scene. When the water in the bomb is added with fertilizers, the liquid projecting bombs of the present invention can be used in fertilizing. When the water in the bomb is added with pesticides, the bombs can be used in pest control or epidemic prevention. When a ship is provided with the projecting device of the invention, the projecting device can execute extinguishing fires at ships, offshore platforms, or onshore facilities.

Since the working range of the liquid projecting bombs delivered by the projecting devices of the present invention could be hundreds of meters or even thousands of meters, whereas the working range of the general water hydrant employing a principle of ejecting water can barely reach to about one hundred meters, thus, the present invention is also advantageous in some special circumstances for its capacity of being used distantly. It can also be used to expel people to leave remote with low intensity in occurrences that maintenance of order, such as illegal protest, looting, or street fighting. Certainly, it can also be used to expel pirates, or ships that enter territorial sea illegally.

Alternatively or in addition, instead of water as the functional liquid, alcohol or fuel can be filled into the liquid projecting bombs as the functional liquid to accomplish different functions. For example, liquid projecting bombs filled with alcohol as the functional liquid can be projected to accomplish disinfect work distantly; the liquid projecting bombs being filled with highly concentrated alcohol and fuel as the functional liquid can be used in land reclamation so as to accomplish safe and quick reclaiming of wasteland. All these applications are within the claimed protection scope of the invention.

Tests indicate that, the projecting device of the present invention can deliver the liquid projecting bombs remotely according to the delivery method of the invention. The following chart provides data for this.

| Parameters | Unit | Value | Value |
|---|---|---|---|
| Inner diameter of the projecting barrel | mm | 120 | 120 |
| Length of the projecting barrel | m | 2.5 | 5 |
| Projecting pressure | Mpa | 0.6 | 1.2 |
| Length of the projecting bomb | m | 0.4 | 0.4 |
| Mass of the projecting bomb | kg | 4.5 | 4.5 |
| Vertical working range at the elevation angle of 45 degrees | m | 134 | 536 |
| Horizontal working range at the elevation angle of 45 degrees | m | 536 | 2142 |

To sum up, the liquid projecting bomb and its projecting device according to the present invention is cost effective, practical, and convenient. The method according to the present invention for delivering the liquid projecting bomb with the projecting device is easy and efficient, thus it is adapted to be popularized widely and its market prospect is broad.

The Second Embodiment

Figure 7:
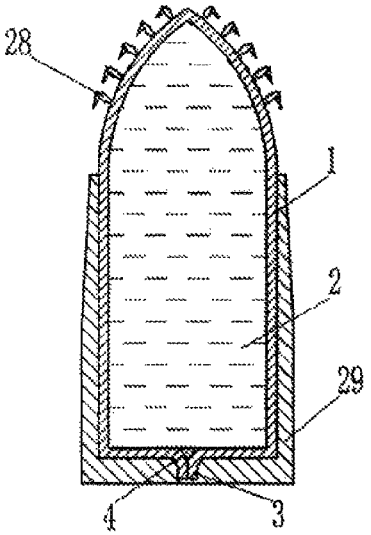
FIG. 7 is a second structural illustration of the liquid projecting bomb of the invention.

The liquid projecting bomb shown in FIG. 7 is different from that in FIG. 1 in that the shell 1 is made of plastic membrane with fire-retardant material and the outer surface of the front of the shell 1 is provided with a shell crack trigger, the shell crack trigger being an integrated sharp means 28 on the body of the shell. The sharp means 28 is made of a material that is the same as that of the shell, i.e. PVC.

The liquid projecting bomb of this embodiment employs a semi-finished shell that is pre-fastened at one end and is manufactured and projected by the projecting device that is described in the first embodiment. The procedure is similar to that of the first embodiment, and thus will not be described in detail. In the solution of this embodiment, the body of the shell 1 is provided with the sharp means 28. When the liquid projecting bomb of the invention is delivered to the target and when the shell is collided, the sharp means 28 would pierce into the shell so that the body of the shell would crack and that the functional liquid inside would disperse, with more reliable effect.

Based on the technical principle of this embodiment, the sharp means 28 could take any other forms. Moreover, the sharp means 28 could be made of different material from that of the shell, such as metal, nylon, and polycarbonate, which are all simple variants based on the principle of the invention, and thus all which are within the claimed protection scope of the invention. Also, based on the principle of this embodiment, it is also possible to provide on the surface of the shell a fragile means by heat sealing or attachment. The fragile means, similar to the sharp means, will results into fragments with sharp tips, such as sheets of hard plastics and so on. They will crack when they are collided, the sharp tips of their fragments will would pierce into the shell during the shell deforms, so that the functional liquid inside the shell will be dispersed. This is also within the claimed protection scope of the invention.

The Third Embodiment

Figure 8:
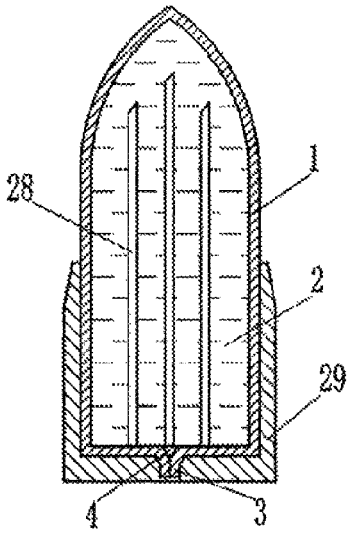
FIG. 8 is a third structural illustration of the liquid projecting bomb of the invention.

The liquid projecting bomb of the invention shown in FIG. 8 is different from that of the second embodiment in that a shell crack trigger is provided inside the shell. The shell crack trigger comprises cylindrical hard means 28 having a sharp corner and arranged inside the body of the shell. The hard means 28, made of a material that is different from that of the shell, are specifically made of hard engineering plastics and are integrated with the plastic membrane with fire-retardant material that constitutes the shell in advance by heat sealing.

The liquid projecting bomb of this embodiment can also be manufactured and projected by the projecting device of the first embodiment. The procedure is similar to that of the first embodiment, and thus will not be described in detail.

Because of the shell crack trigger arranged inside the shell, after the liquid projecting bomb of the invention is delivered to the target and when the shell is collided, the cylindrical hard means with a sharp corner 28 pierce into the shell and assist in cracking the body of the shell so that the functional liquid inside disperses, with more reliable effect.

Similarly, based on the principle of this embodiment, other than being cylinders, the hard means 28 can also be in any other forms such as cones, triangular pyramids, and rectangular pyramids, all of them being able to produce a good effect.

For the liquid projecting bombs of the invention whose shell are made of soft materials, less inadvertent damages, better delivery effects, higher efficiency, and better practicability during delivering of the liquid projecting bomb can be obtained by adding the propelling mount 29 to the shell 1 of the liquid projecting bomb.

The Fourth Embodiment

Figure 9:
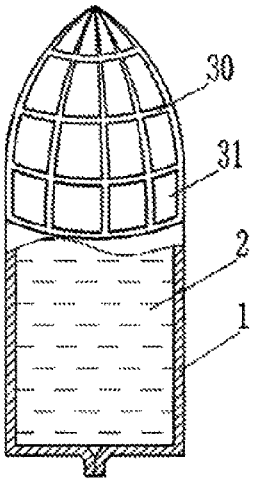
FIG. 9 is a fourth structural illustration of the liquid projecting bomb of the invention.

The liquid projecting bomb of the invention shown in FIG. 9 is different from that of the third embodiment in that the shell 1 is made of a hard plastic that is fire-retardant and is capable of degrading naturally. A shell crack trigger is also provided on the outer surface at the front of the shell 1. The shell crack trigger is provided as multiple locally weaken zones 31 on the body of the shell. Thickness of the portions of the shell enclosed by ribs 30 (i.e. the locally weaken zones 31) that are in a crisscross pattern is less than thickness of the ribs and lower portion of the shell. It should be noted that the shell in technical solution of this embodiment is made of hard plastic, which is capable of withstanding much stronger stress than the more soft plastic membrane. Thus, the shell of this embodiment does not need to provide the propelling mount.

Figure 10:
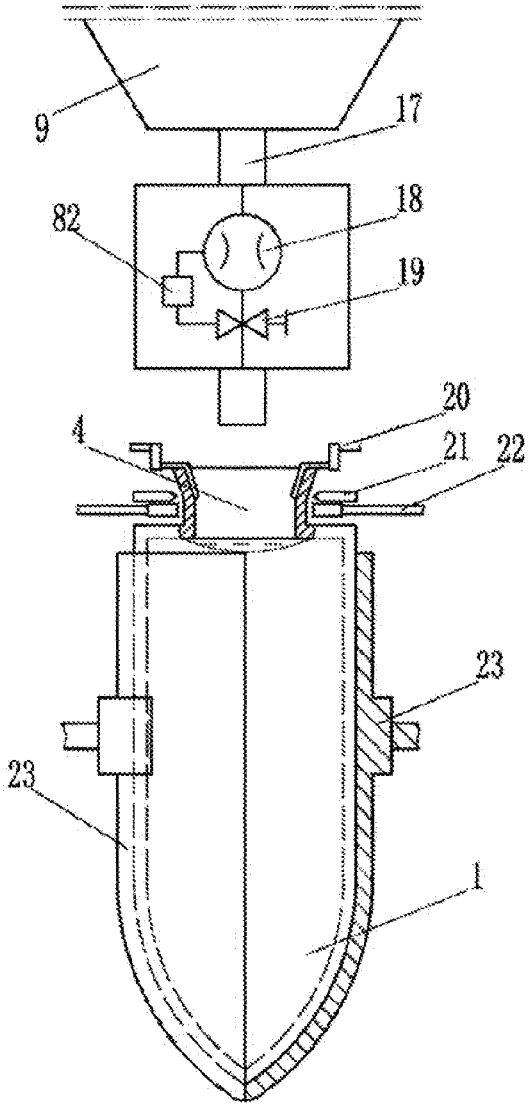
FIG. 10 is a second structural illustration and its working mechanism illustration of the bomb-packaging device of the projecting device of the invention.
Figure 11:
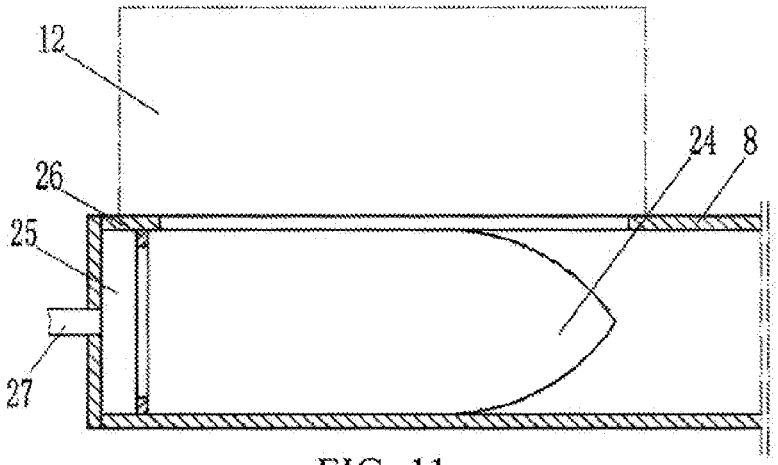
FIG. 11 is a second sectional view of FIG. 3 taken along the line of B-B.

As shown in FIG. 10, the projecting device of this embodiment is different from that of the first embodiment in that the bomb-packaging device of the projecting device of this embodiment only consists of the feeding tube 17, the metering device, the feeding switch 19, the shell holding device 23, the shell-opening device 20, and the shell-closing device, other parts being exactly the same. Following is a detailed description of the process of manufacturing the liquid projecting bomb with the bomb-packaging device of the projecting device of this embodiment, with reference to FIG. 10. First, sending the shell to the filling station, where the shell-opening device 20 opens the feeding channel 4 of the shell 1 and the shell holding device 23 holds the whole shell externally at the same time; then, the water in the liquid storage tank 9 enters into the bomb-packaging device through the feeding tube 17 and water metered by the metering device is filled into the shell 1 along the opened feeding channel 4 metering device; when volume of the water flowing through the flow controller 18 reaches a determined value, the shell 1 is full of the water, the signal control device 82 is actuated, and the feeding switch 19 is turned off, stop filling the shell 1 with water; then the heat-sealing device 22 is actuated to seal the feeding channel 4, and the cutting device 21 cuts off the redundant portion of the shell, thus a finished liquid projecting bomb 24 is produced. The finished liquid projecting bombs are loaded into the projecting chamber 25 of each projecting barrel 8 and then are ready for being projected, as shown in FIG. 11.

The procedure of delivering the liquid projecting bombs shown in FIG. 9 with the projecting device of this embodiment is similar to that described in the first embodiment, and thus is not repeated here.

The liquid projecting bomb of this embodiment is provided with locally weaken zones 31, and after being delivered to the target, the shell of it is more easy to crack due to uneven distribution of strength of the shell when the shell is collided. Thus, the functional liquid inside the shell disperses and use of the liquid projecting bomb is more reliable. Also, because of the employment of the material that is fire-retardant and is capable of degrading naturally, the liquid projecting bomb of this embodiment does not pollute the environment after being used, and thus is more environmental-friendly.

The Fifth Embodiment

Figure 12:
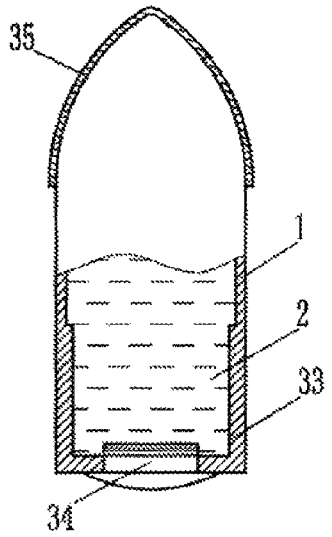
FIG. 12 is a fifth structural illustration of the liquid projecting bomb of the invention.

The liquid projecting bomb of the invention shown in FIG. 12 is different from that of the third embodiment in that the shell 1 is made of a hard plastic, and in order to optimize flight attitude of the bomb during flying and to ensure accuracy of delivery; a fairing 35 is integrally formed with the head of the shell; moreover, in order to improve local strength and to prevent inadvertent damage of the tail of the shell due to force during projecting, the tail of the shell 1 is provided with a local reinforcement layer 33, and the shell at the local reinforcement layer 33 is thicker than any other portion of the shell, in order to adapt to higher hydraulic pressure at the lower-half section of the liquid projecting bomb during projecting due to the counteracting inertia force, hence, whole front portion of the shell 1 is like the locally weaken zone; also, in order to seal the water 2 inside the sealed shell 1, a soft rubber plug 34 is provided at the feeding channel of the tail of the shell.

For the shell has the fairing 35 at the front, the strength of the front of the shell 1 gets improved. This can decrease deformation of the front of the liquid projecting bomb during flying so that air drag is minimized, thus, is advantageous in improving accuracy of delivery. Furthermore, if the fairing 35 is made of a high strength and fragile material, then fragments resulted from crack of the fairing assist in piercing into the shell and cracking the body of the shell, so that the functional liquid inside disperses. Meanwhile, the fairing also acts as the shell crack trigger mentioned above.

Figure 13:
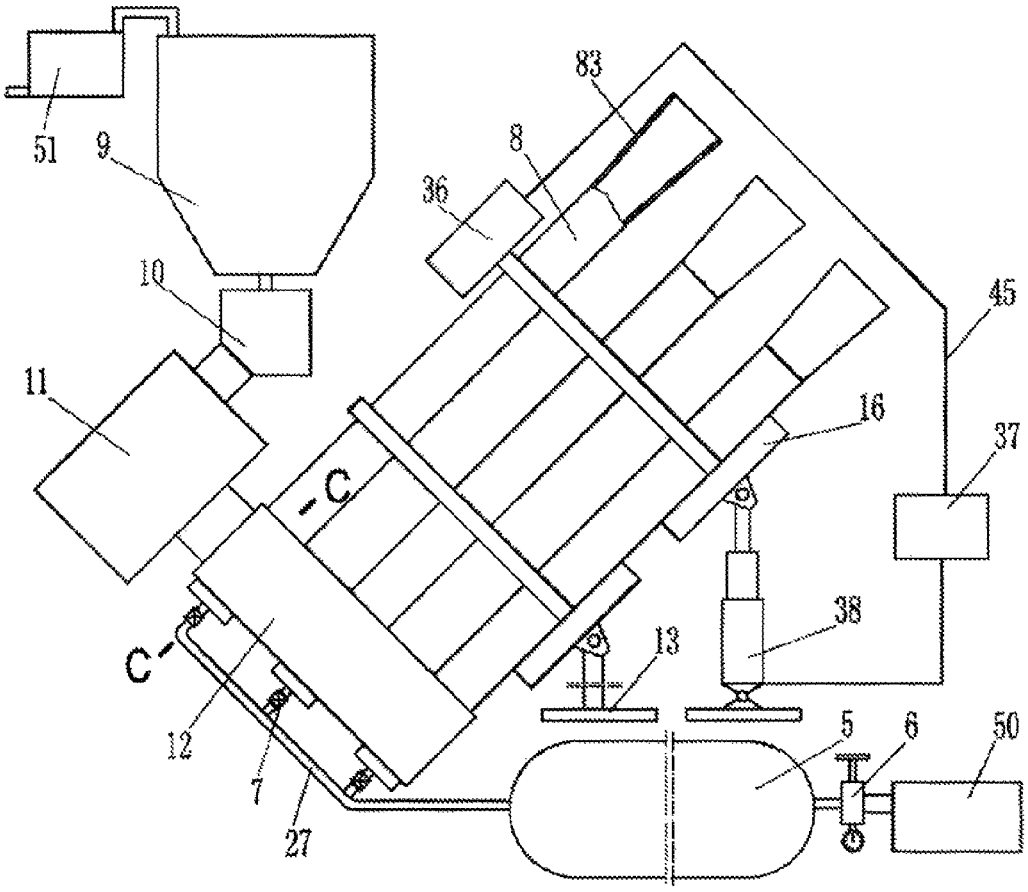
FIG. 13 is a second structural illustration of the projecting device of the invention.
Figure 14:
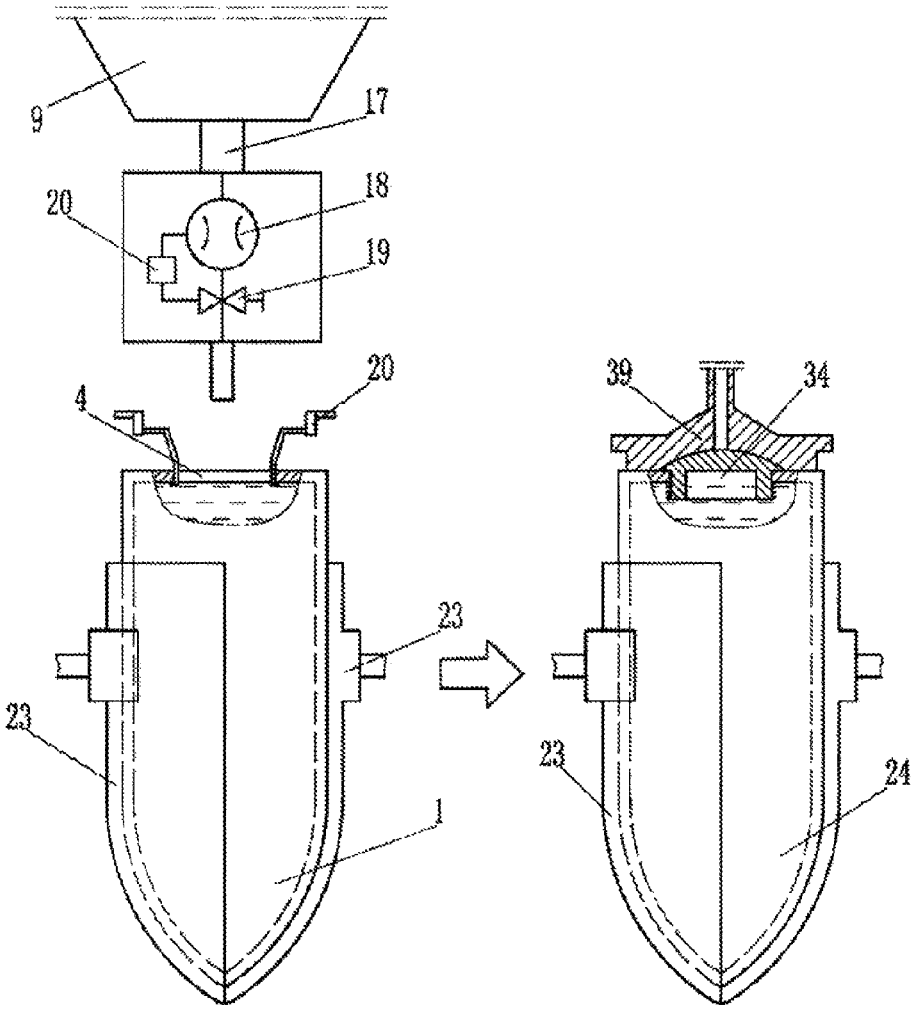
FIG. 14 is a third structural illustration and its working mechanism illustration of the bomb-packaging device of the projecting device of the invention.
Figure 15:
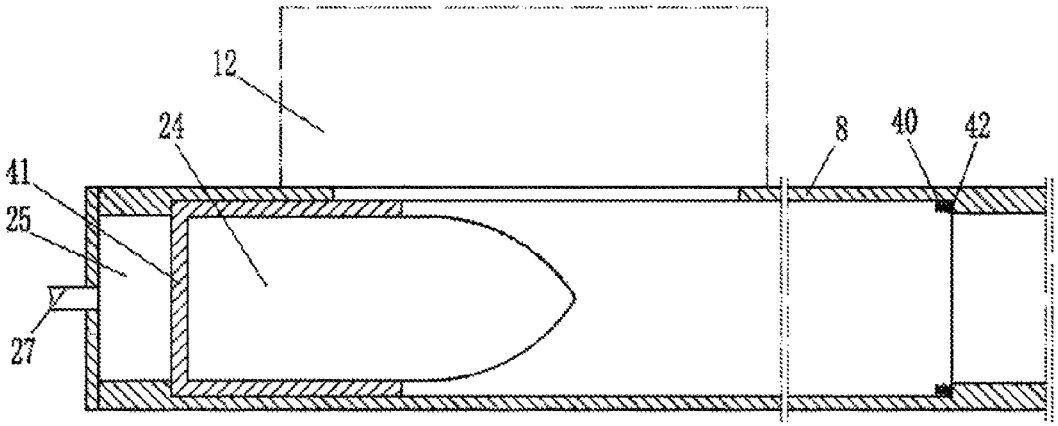
FIG. 15 is a sectional view of FIG. 13 taken along a line of C-C.

The projecting device of the invention shown in FIG. 13 is different from that of the first embodiment in that it arranges three projecting barrels 8 in each column into a group, each group of projecting barrels sharing one projecting switch 7. Each projecting switch 7 is provided with an automatically switch-off mechanism, and a delay switch-on mechanism is placed between the adjacent projecting switches 7, the previous one of the automatically switch-off mechanisms of the projecting device is actuated jointly with the next one of the delay switch-on mechanisms of the projecting device. A pressure-relief device is provided on the projecting barrel 8, which is in form of an enlarged section 83 near the outlet of the projecting barrel 8, inner diameter of the enlarged section 8 increases gradually from inner end to outer end. The sighting system further comprises a meteorological sensing system and a bomb trajectory calculation system. The meteorological sensing system comprises an anemometer 36. Results measured by the anemometer 36 are input into the bomb trajectory calculation system 37 through a data cable 45. The trajectory calculation system 37 automatically calculates the optimum bomb trajectory projected and thus projecting pressure and sighting parameters of the projecting barrel groups. Moreover, the front supporting leg of the projecting device of this embodiment is a hydraulic supporting leg 38. In uses, the hydraulic supporting leg 38 is controlled in accordance with the calculated results from the trajectory calculation system 37 to adjust the elevation angle of the projecting barrel groups to realize that the trajectory for the liquid projecting bomb is the optimum trajectory. Also, compared with the bomb-packaging device shown in FIG. 5, structure of the bomb-packaging device of the projecting device in this embodiment shown in FIG. 14 is simpler, whose shell-closing device is simply a soft rubber plug 34. When the shell 1 is filled with water, the shell holding device 23 holds the semi-finished liquid projecting bomb and sends it to the next station where a vacuum-sorbing device 39 is provided; the vacuum-sorbing device 39 carries the soft rubber plug 34 and assembly it to the tail of the semi-finished liquid projecting bomb so that the shell is sealed and that the finally finished liquid projecting bomb 24 of the invention shown in FIG. 12 is produced. Furthermore, as shown in FIG. 15, in the projecting device of this embodiment, a propelling mount barrel 41 is further provided in the projecting chamber 25 of each projecting barrel 8 constituting the projecting barrel groups. A propelling mount barrel restoring mechanism also provided inside the corresponding projecting barrel 8. The propelling mount barrel restoring mechanism consists of stop steps 42 provided on the inner wall of the projecting barrel 8 and restoring springs 40 fixedly set on the stop steps 42. In order to work for a long period, the functional liquid source of the projecting device of the invention comprises the liquid storage tank 9 and a liquid transportation pump 51, wherein the liquid transportation pump 51 is in connected with the liquid storage tank 9 so that water nearby can be filled into the liquid storage tank 9.

Procedure of delivering the liquid projecting bombs shown in FIG. 12 by the projecting device of the invention is described as follows: (1) using the bomb-packaging device to pack water as a readily accessible functional liquid into the shell 1 to make the liquid projecting bomb 24; (2) storing the finished liquid projecting bombs 24 in the bomb storage 11 of the projecting device; (3) determining the target for projecting, and stably placing the projecting device near the target according to its working range; (4) using the anemometer 36 and the trajectory calculation system 37 to determine the optimum projecting trajectory curve and the projecting parameters, and to adjusting the elevation angle of the projecting barrel groups through the hydraulic supporting leg 38; (5) aiming at the target, and using the bomb-loading device 12 to load the liquid projecting bombs 24 stored in the bomb storage 11 into the propelling mount barrel 41 of each projecting barrel 8 and closing the projecting chamber 25; (6) determining whether the pressure in the accumulator-regulating tank meets the required projecting pressure in accordance with the parameters; when the pressure is greater than the projecting pressure, using the pressure-regulating device 6 to relieve the pressure, whereas when the pressure is less than the projecting pressure, using the pressure-regulating device 6 to increase the pressure by utilizing the compressed air source until the pressure in the accumulator-regulating tank 5 reaches the determined projecting pressure; (7) as shown in FIGS. 13 and 15, switching on a projecting switch 7 to connect the accumulator-regulating tank 5 with the projecting chambers of a group of projecting barrels, compressed air enters the projecting chambers of the first group of the projecting barrels pushing out the liquid projecting bomb 24 and the propelling mount barrel together in each projecting chamber. The propelling mount barrel 41 strikes restoring springs 40 on the stop steps 42, and gets rebounded and restored, whereas the liquid projecting bomb 24 is pushed out of the projecting barrel 8. In the meantime, the projecting switch 7 turns off and pushes out the rest liquid projecting bombs in the other projecting barrel groups successively with a time delay; (8) correcting parameters such as the horizontal angle, the elevation angle, and the projecting pressure of the projecting barrel 8 according to the impact point during projecting; (9) the next group of liquid projecting bombs 24 are loaded into the propelling mount barrel 41 of each projecting barrel 8, respectively, and another round of projecting is continued.

In the projecting device of this embodiment, an enlarged section 83 is provided with the projecting barrel 8 near its outlet and inner diameter of the enlarged section 83 increases gradually from a inner end to an outer end presenting a broadened form. Thus, during the projecting of the liquid projecting bombs and when the bomb passes the enlarged section 83, the shell of the liquid projecting bomb becomes larger as the inner diameter of the projecting barrel changes at the beginning. When constrained by original dimensions of shell and tension, the projecting barrel no longer gets larger, a gap appears between the wall of the projecting barrel and the liquid projecting bomb and gas gradually leaks out from the gap, thus pressure in the projecting barrel is gradually relieved. When the liquid projecting bomb completely leaves the projecting barrel, the shell of the liquid projecting bomb is already capable of withstanding the relieved pressure. By this way, it can be effectively prevented that the problem of damage of the shell is due to a large pressure difference between the bottom of the liquid projecting bomb that withstands a high projecting pressure and the front that withstands only the atmospheric pressure when the liquid projecting bomb is partially out of the projecting barrel. Also, other than using the restoring springs in the propelling mount barrel restoring mechanism to help the propelling mount barrel 41 to restore, other means such as air vents provided on the projecting barrel can also be used to help the propelling mount barrel 41 to restore, which is also within the claimed protection scope of the invention.

Based on the principle of the invention, the meteorological sensing system comprises at least one of the anemometer, the anemoscope, the barometer, and the thermometer. Also, the arrangement of the projecting barrel groups can be combined based on needs. For example, other than the mentioned arrangement in which every three projecting barrels make up one group in this embodiment, it is possible that every four projecting barrels of a row consist one group and share a projecting switch. It is also possible that every two of the four projecting barrels of a row consist together and share a projecting switch. Both of them can provide a good effect.

The structure of the projecting device of this embodiment is simpler. Due to the propelling mount barrel provided in the projecting barrel, the liquid projecting bombs can be prevented from damage during projecting with higher delivery efficiency and better protection effect. Particularly when the liquid projecting bomb is made of a soft material that is easy to crack when bumped, the protection effect is even better. When the liquid projecting bombs shown in FIGS. 1, 7, and 8 are projected, they even need not propelling mount, which is good for simplification of the structure of the liquid projecting bomb. Moreover, since propelling mount is not needed, the structure of the bomb-packaging device of the projecting device of the invention can be simplified accordingly. For example, if no propelling mount is needed, the bomb-packaging device shown in FIG. 6 could be free of the vacuum-sorbing device 32. This solution is just a simple derivative of the invention, which shares the similar principle to this solution, and thus is only described in text and is also within the claimed protection scope of the invention.

It should be noted that, if the projecting device shown in FIG. 13 is installed on a ship, it could be further used for marine fire fighting for facilities such as ships and oil platforms. Since in these situations water is abundant and is readily accessible, the functional liquid source of the projecting device can consist of only the liquid transportation pump 51, by which the functional liquid can be provided directly to the bomb-packaging device, and thus the same effect can be carried out. This is also applicable to other embodiments of the invention, and thus is also within the claimed protection scope of the invention.

Of course, although in this embodiment water is used as the functional liquid, other additives can be added into water or other functional liquids can be used depending on various uses in real applications. For example, when the liquid projecting bomb of this embodiment is used in fire extinguishing, it is possible to add fire-extinguishing agents into the water; when the liquid projecting bomb is used in wasteland and barren mountain management, it is possible to add liquid fertilizers into the water; when the liquid projecting bomb is used in pests prevention and cure of forests and grassland or epidemic situation prevention and cure of a disaster area, it is possible to add pesticides into the water; when the liquid projecting bomb is used in remote disinfection a disaster area, it is possible to project liquid projecting bombs using medical alcohol or a solution mixed with drugs as the functional liquid; when the liquid projecting bomb is used in reclamation work, the liquid projecting bomb filled with fuel as the functional liquid is used in order to reclaim efficiently and safely. All of these applications are within the claimed protection scope of the invention and thus will not be exemplified in detail.

The Sixth Embodiment

Figure 16:
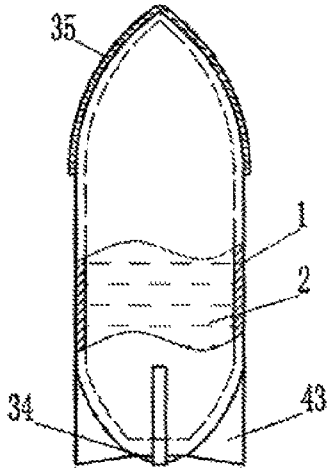
FIG. 16 is a sixth structural illustration of the liquid projecting bomb of the invention.

The liquid projecting bomb of the invention shown in FIG. 16 is different from that of the fifth embodiment in that the shell 1 is made of a sheet of hard paper. The hard paper is coated with waterproof material on inner surface and is experienced with fire-retardant treatment by soaking in fire-retardant liquid. Also, the shell 1 is provided with both the fairing 35 and stabilizing wings 43. The fairing 35 is made of fragile and hard plastic and is adhered to the head of the shell 1.

Figure 17:
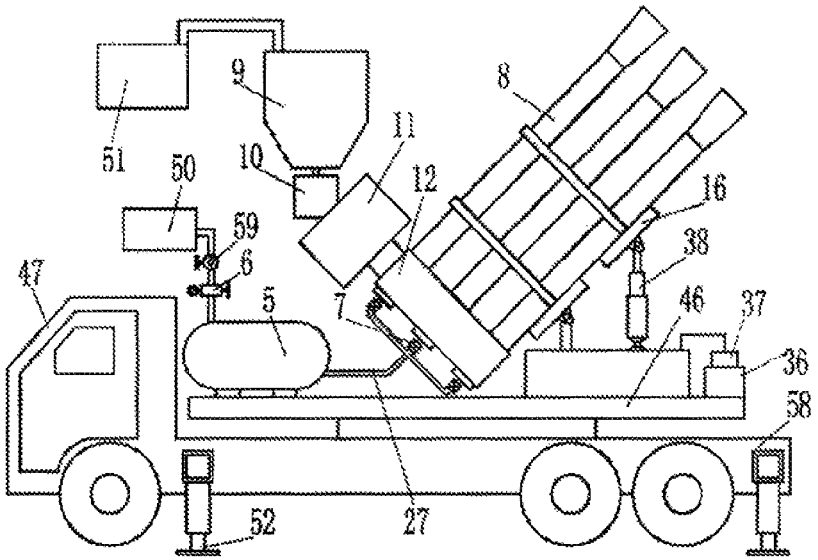
FIG. 17 is a third structural illustration of the projecting device of the invention.

The projecting device of the invention shown in FIG. 17 is different from the projecting device of the fifth embodiment in that the sighting system further comprises a rotational angle adjusting mechanism, and the rotational angle adjusting mechanism is a rotary chassis 46. The projecting barrel groups are installed on the rotary chassis 46 and an elevation angle adjusting mechanism is provided between the projecting barrel groups and the rotary chassis 46, the elevation angle adjusting mechanism being the hydraulic supporting leg 38. Also, the compressor air source 50, the accumulator-regulating tank 5, and the projecting barrel group consisting of multiple projecting barrels 8, the liquid transportation pump 51, the liquid storage tank 9, the bomb-packaging device 10, the bomb storage 11, the bomb-loading device 12, the rotary chassis 46, and the likes are all arranged on the fixed chassis 58 integrated with the truck 47, constituting a projecting truck. The projecting truck is further provided with hydraulic stabilizing legs 52. The procedure of manufacture and projecting of the liquid projecting bombs of this embodiment shown in FIG. 16 is similar to that of the fifth embodiment, and thus is not described in detail here. It should be noted that, before projecting with the projecting device of the invention, the hydraulic stabilizing legs 52 should lift the rest part of the projecting truck so as to ensure the truck being horizontal and stable. Moreover, due to existence of the rotary chassis 46, after the liquid stabilizing legs 52 having been adjusted and when a horizontal adjustment of the projecting direction is needed, just rotating the rotary chassis 46 would suffice and moving the projecting truck is no longer needed, which is fairly convenient. In order to prevent inadvertent pressure relief of the accumulator-regulating tank 5, a one-way valve 59 is placed between the accumulator-regulating tank 5 and the compressed air source 50.

The liquid projecting bomb of this embodiment of the present invention is also provided with both the fairing 35 and the stabilizing wings 43, which make a more stable flying and a higher accuracy of delivery. The projecting device of this embodiment of the present invention has a better mobility, is more convenient and adapted to field work because it is equipped with the truck 47. It should be noted that, based on the technical principle of the liquid projecting bomb of this embodiment, just providing the shell with stabilizing wings would also provide a good effect. Also, although in this embodiment description is carried out on an example provided four stabilizing wings evenly, examples provided with three, five, or more stabilizing wings in practical applications are also possible, and can obtain same effects. Generally speaking, the stabilizing wings are distributed in even form. Based on the principle of this embodiment and on different uses, the sighting system can also be provided with the rotational angle adjusting mechanism instead of the elevation angle adjusting mechanism. Due to the fragile material that is used to make the fairing 35, fragments resulted from crack of the fairing assist in piercing through the shell when the fairing is collided, so that the functional liquid inside is dispersed. Therefore, the fairing 35 of this embodiment also functions as the shell crack trigger.

It should also be noted that, all functional devices of this embodiment of the projecting device of the present invention are integrated into one truck. In practical applications, it is also possible to provide some of the functional devices on other trucks. For example, the water pump and the liquid storage tank can be provided on another truck. Following is a description of benefits of such application: when fire is raging and enough water cannot obtained on the scene, multiple dedicated trucks that have water pumps and liquid storage tanks can be used to get water nearby and to transport the water to the scene of the projecting device of the present invention and, therefore, restriction to volume of a single liquid storage tank and drawback of being incapable of accomplishing fire extinguishing task of large projecting volume for a single dedicated transportation truck can be solved. Meanwhile, restriction to space of a single dedicated transportation truck and problem of being difficult to containing all functional devices of the projecting device of the invention together can be solved. Furthermore, it provides better mobility and is good for work of high volume delivery. Based on the principle mentioned above, it is also possible to set the accumulator-regulating device on one of additional dedicated transportation trucks. Technical solutions of having the functional devices of the projecting device of the invention distributed in one, two, or more dedicated transportation trucks are basically under the same principle and are thus within the claimed protection scope of the invention.

Based on content of this embodiment, the shell of the liquid projecting bomb of the invention could be made of a plastic or a composite of the hard paper and the plastic other than the hard shell. Moreover, for purpose of environment protection, the shell is preferably made of a material that is capable of degrading naturally. All of them are simple applications of the principle of the invention and, thus, all are within the claimed protection scope of the invention. Also, for purpose of fire retardation, the hard paper that constitutes the shell could be experience fire-retardant process by soaking with fire-retardant liquid. In practical applications, the fire-retardant process could takes in various forms. For example, it could be in form of arranging a fire-retardant layer by processes such as adhesion or coating on the surface of the shell. Both of them are able to realize the same effect and, thus, are within the claimed protection scope of the invention without being further explained in detail.

The Seventh Embodiment

Figure 18:
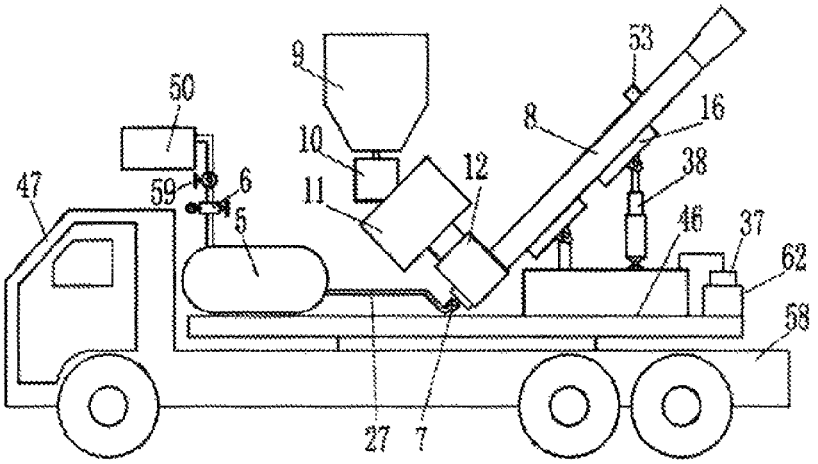
FIG. 18 is a fourth structural illustration of the projecting device of the invention.

The liquid projecting device of the invention shown in FIG. 18 is different from the projecting device of the sixth embodiment in that the liquid storage tank 9 does not need the water pump when only extinguishing fire at high-rise buildings in urban area, since water is readily accessible in urban area and more space can be saved by eliminating the water pump. Also, many fires in urban area are limited in scope nevertheless needs accurate delivery, thus the projecting device of this embodiment possesses only one projecting barrel 8 that is elongated appropriately. Moreover, due to higher delivery accuracy demanded in fire extinguishing in urban area, the sighting system 62 of the projecting device of this embodiment of the present invention comprises a laser rangefinder, an optical sight, an elevation angle measurement device, and an rotational angle measurement device, and the meteorological sensing system of the sighting system 62 comprises an anemometer, an anemoscope, a barometer, a thermometer, and the rotational angle adjusting mechanism and/or the elevation angle adjusting mechanism that are identical to that of the sixth embodiment. Results measured by the meteorological sensing system are input into the trajectory calculation system 37 and, thereby the projecting pressure and the sighting parameters of the projecting barrel are calculated and the corresponding elevation angle, horizontal angle, and projecting pressure are adjust accordingly. In order to further improve the accuracy of delivery, the sighting system further comprises a manually correcting device 53 for impact point.

The manually correcting device 53 for impact point calculates adjusting values for the projecting pressure or the sighting parameters of the projecting barrel based on deviation between the designed impact point and the measured impact point and manually adjusts the horizontally rotational angle, the elevation angle of the projecting barrel, or the pressure of the accumulator-regulating tank with a hand wheel. Of course, based on the technical principle mentioned above, an automatically correcting device for impact point can be used instead of the manually correcting device for impact point, depending on calculating the adjusting value for the projecting pressure or the sighting parameters of the projecting barrel with a software system and sending a signal to the rotational angle adjusting mechanism, the elevation angle adjusting mechanism, or the pressure-regulating device in order to automatically adjust the horizontally rotational angle, the elevation angle, or the pressure of the accumulator-regulating tank. This can also realize an accurate correction to the impact point and, thus, is also within the claimed protection scope of the invention.

Furthermore, the measuring tools involved in the sighting system of the projecting device of the embodiment are more and are more accurate and, with use of the manually correcting device for impact point together, can substantially improve the accuracy of delivery of the projecting device and reduce inadvertent losses of surroundings due to mistake deliveries and, thus satisfy using requirements of fire extinguishing in urban area.

The Eighth Embodiment

Figure 19:
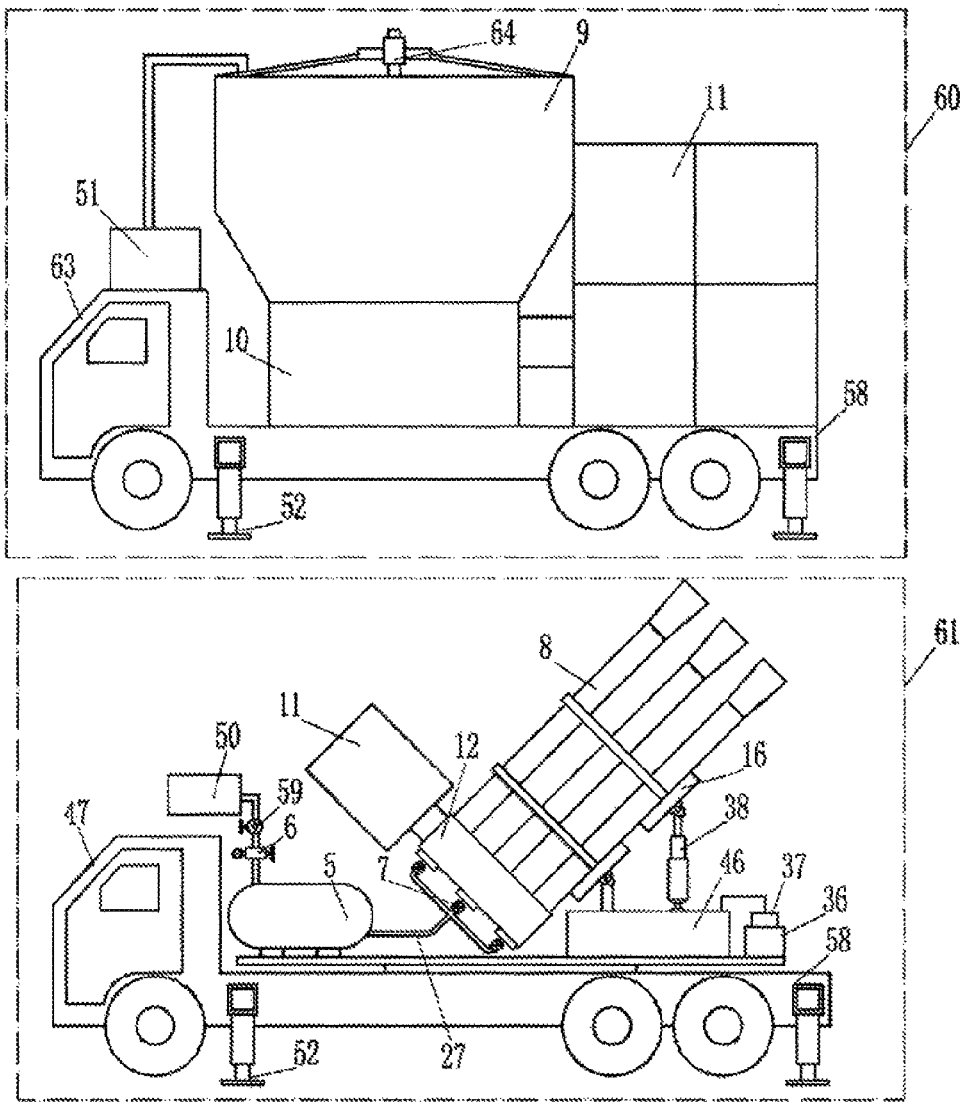
FIG. 19 is a fifth structural illustration of the projecting device of the invention.

The projecting device of the invention shown in FIG. 19 is different from the projecting device of the sixth embodiment in that the liquid storage tank 9, the bomb-packaging device 10, and the bomb storage 11 of the projecting device are provided on another truck 63, constituting a bomb-packaging truck 60. The rest parts of the projecting device and the other bomb storage 11 are still on the truck 47, constituting a projecting truck 61. In order to ensure to be stable when working, the liquid stabilizing legs 52 are provided on both the bomb-packaging truck 60 and the projecting truck 61.

In this embodiment, the projecting devices are provided on two trucks and they constitute the bomb-packaging truck 60 and the projecting truck 61 that cooperate with each other. The bomb-packaging truck 60 takes charge of collecting and storing the functional liquid, manufacturing the liquid projecting bombs and storing them, and supplying the liquid projecting bombs to the projecting truck when being in applications. The bomb storage of the projecting truck can be exchanged for the bomb storage of the bomb-packaging truck. When the liquid projecting bombs in the bomb storage of the projecting truck are all projected, the empty bomb storage is unloaded and another bomb storage that is full of the liquid projecting bombs made by the bomb-packaging truck 60 can be suspended and carried to the projecting truck 61, matching the bomb storage with the bomb-loading device 12. Then, another round of projecting could be initiated. The empty bomb storage is carried back to the bomb-packaging truck and is reloaded with the liquid projecting bombs and, then, recycle of the bomb storage is accomplished. Since the projecting devices are provided on two trucks, which is more spacious, capacities of storage and manufacturing the liquid projecting bombs of the projecting device of the invention are substantially improved, and projecting in large scale is guaranteed. Moreover, when there is no water source near the working place, two bomb-packaging trucks 60 can take turns to get water from a water source nearby and manufacture the liquid projecting bombs for supplying for the projecting truck 61 so as to meet demands when the bombs are used in high volume. Of course, in order to get water conveniently, as shown in FIG. 19, the liquid transportation pump 51 can be provided with the bomb-packaging truck 60 so as to use with the liquid storage tank 9 cooperatively.

Based on different uses, before the projecting device of the invention manufactures the liquid projecting bombs, it is sometimes needed to mix additives, such as fire-extinguishing agents, fertilizers, or pesticides into the water inside the liquid storage tank. In order to mix uniformly with the additives, it is also possible to provide the liquid storage tank 9 with a stirring device 64. Of course, based on the technical principle of the invention, it is also possible to provide a separate stirring device 64. When needed, manually stirring with the stirring device can realize the same effect, and it is also within the claimed protection scope of the invention. Since the stirring device that is used to mix liquids is a common apparatus in use, any kind of existing stirring devices can be used which do not need to be explained in detail.

According to the technical principle of this embodiment, it is also possible not to provide the projecting truck 61 with the bomb storage. Instead, an interface of the bomb-loading device 12 is provided on the projecting device to mate with the bomb storage 11. In use, the bomb-loading device 12 of the projecting truck is directly mated with the bomb storage on the bomb-packing truck 60. The bomb-loading device 12 can be used to receive the liquid projecting bombs from the bomb storage 11, and load them into the projecting chamber of the projecting barrel 8 to finish projecting. This is also within the claimed protection scope of the invention.

It should be noted that, based on the technical principle of this embodiment, it is also possible to have more than three trucks in this invention. For example, the compressed air source 50 can be provided on the third truck. Generally, the projecting truck should include a rotary chassis, a fixed chassis, and a truck, the rotary chassis being rotatable relative to the fixed chassis. At least a bomb-loading device, a projecting barrel, and an accumulator-regulating tank are placed on the rotary chassis. The fixed chassis is fixed onto the truck. The rest parts can be provided either on the bomb-packaging truck or on the third truck.

The Ninth Embodiment

Figure 20:
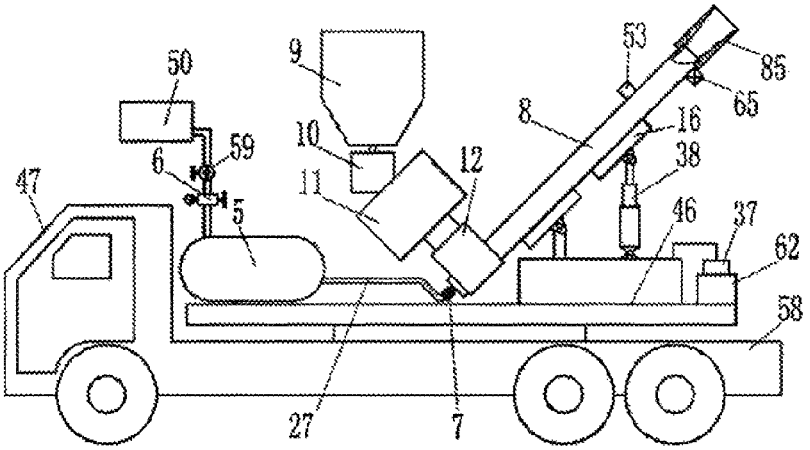
FIG. 20 is a sixth structural illustration of the projecting device of the invention.

The projecting device of the invention shown in FIG. 20 is different from the projecting device of the seventh embodiment in that the front of the projecting barrel 8 is provided with a sensing and actuating mechanism for bombs leaving the barrel and that the projecting switch 7 is provided with an automatically switch-off mechanism. The sensing and actuating mechanism for bombs leaving the barrel comprises a pressure sensor 65, the pressure sensor 65 being connected with the automatically switch-off mechanism of the projecting switch 7 through circuits (now shown). Also, the front of the projecting barrel 8 is provided an enlarged section 85 that is broadened. The enlarged section 85 has a taper angle inside chamber of the projecting barrel. Specifically, diameter of the chamber of the projecting barrel increases gradually from inside to the outlet and takes a horn form.

It should be noted that in this embodiment, the enlarged section 85 provided in the projecting barrel and the enlarged section 83 provided in the projecting barrel of the fifth embodiment are functionally identical to each other. Also, the projecting barrel 8 is made by joining and fixing two different materials. The enlarged section 85 provided with a horn form chamber of the projecting barrel is made of tubing materials with larger diameter and thicker wall thickness. This configuration makes the manufacturing of the projecting barrel much easier in terms of material selection or manufacturing and, thus is good for lowing cost. The structure of the projecting barrel 8 described in this embodiment is also applicable to the projecting devices in other embodiments of this invention and then its detail description with reference to figures is omitted.

During projecting, the pressure sensor 65 of the sensing and actuating mechanism for bombs leaving the barrel senses pressure change inside the projecting barrel while the liquid projecting bomb being projected out of the projecting barrel 8, and then sends an electrical signal to the projecting switch 7 actuating the automatically switch-off mechanism to turn off the projecting switch so as to prepare for the next round of projecting.

Based on the technical principle of this embodiment, the sensing and actuating mechanism for bombs leaving the barrel can also be realized by a photoelectric sensor and relevant circuits. The photoelectric sensor is used to sense the projecting of the liquid projecting bomb and then sends an electrical signal to the projecting switch 7 actuating the automatically switch-off mechanism to turn off the projecting switch so as to prepare for the next round of projecting. Thus, an identical effect is realized. Also, based on this controlling principle, it is also possible to connect the projecting sensor mechanism with the automatically switch-off mechanism of the projecting switch 7 and the bomb-loading device 12 through circuits. As such, after the pressure sensor senses the projecting of the liquid projecting bomb, a signal is sent to the bomb-loading device 12 and the automatically switch-off mechanism of the projecting switch 7 in order. Then, the automatically switch-off mechanism is triggered to turn off the projecting switch 7, and then the projecting chamber is opened and is refilled with the liquid projecting bombs with the bomb-loading device 12. Doing such enhances extent of automation of the projecting device and improves projecting efficiency. Of course, it is also possible to use only the sensing and actuating mechanism for bomb leaving the barrel to provide controlling signal, so as to control the bomb-loading device 12 and open the projecting chamber. These are all simple derivations of the solution of the invention and, thus, are within the claimed protection scope of the invention. It should be noted additionally that the solution mentioned above is also applicable to other solutions of the invention.

Since the projecting device of this embodiment is mainly used for fire-fighting in urban area, where fire-fighting facilities are well established and water is readily accessible, the functional liquid source of the projecting device of this embodiment could be the liquid transportation pump instead of the liquid storage tank 9. In uses, getting water from fire-fighting water sources or drinking water sources and providing the water as the functional liquid directly to the bomb-packaging device with the liquid transportation pump are also very effective. Moreover, since the liquid storage tank 9 is eliminated, the projecting device of the invention has a simpler structure that occupies less space and can be transported with a smaller truck 47 with a less horsepower. This further improves the mobility and lowers the cost of fire fighting.

The Tenth Embodiment

Figure 21:
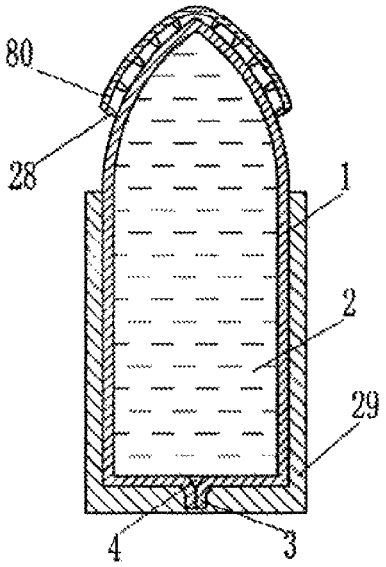
FIG. 21 is a seventh structural illustration of the liquid projecting bomb of the invention.

The liquid projecting bomb of the invention shown in FIG. 21 is different from the liquid projecting bomb shown in FIG. 7 in that the shell-cracking trigger on the surface of the shell 1, which in addition to the sharp means 28 integrally formed on the shell, further comprises a fragile means 80 that is fixedly provided on the top of the sharp means 28 by heat sealing. The fragile means 80 is made of a hard plastic and can be used as a fairing as well.

The liquid projecting bomb of this embodiment of the invention can also be manufactured and projected with the projecting device in the first embodiment and procedure is same as that in the first embodiment, which is not repeated herein. In the technical solution of this embodiment, shell-cracking trigger consisting of the sharp means 28 and the fragile means 80 is provided on the shell 1. When the liquid projecting bomb of the invention is delivered to the target and when the shell is collided, the sharp means 28 would be pushed by the fragile means and pierce into the shell in opposite direction therewith, and at the same time, sharp corners of fragile means 80 produced due to cracking would also assist in piercing the body of the shell, so that the body of the shell would crack and that the functional liquid inside would disperse, with more reliable effect of use. Another significance of additionally providing the fragile means is to protect the sharp means 28 from coming off inadvertently when under a force, to make storage and transportation easier, as well as to be used as a fairing that could decrease drag during flying.

The above embodiment provides some typical structures of the liquid projecting bomb of the invention. In order to make the drawing and the explanation intuitive, the outer shell of the bomb mainly employs a structure with a bomb-like shape. It should be noted that the shape of the liquid projecting bomb of the invention is not limited to the bomb-like shape in practical applications. According to various bomb-packaging devices of the projecting device of the invention, it can be in shapes such as a bag for infusion of fluid or a big sausage, and in order to make the projecting easier, its bottom can be further provided with the propelling mount; both of them can be applied to the invention, as long as they are good for automatic packaging and projecting with air pressure. Since liquid packages in forms of the bag for infusion of fluid or big sausage are common in our daily life, they are only described in text and would not be provided with any other drawings to illustrate. Also, the structure of the bob-packaging device of the projecting device of the invention is not limited to that shown in the drawings, it could employ structures of any existing automatic liquid-filling devices such as packaging and filling machines of VFS series from Packaging Technology, LLC of Zhengyuan, Anhui, or automatic liquid-filling machines from Shanghai Xingfei Packing Machinery, LLC, principles of both of them being applicable to the projecting device of the invention. Of course, for those shells that have already been shaped, it is possible to use only the automatic liquid-filling machine. Using the automatic liquid-filling machines or the packaging machines mentioned above as the bomb-packaging device, it is possible to complete the whole manufacture procedure of the liquid projecting bomb of the invention automatically and, thus manufacture the liquid projecting bombs of the invention in large scale rapidly. The above description is applicable to all embodiments of the invention and, thus falls within the claimed protection scope of the invention.

The Eleventh Embodiment

Figure 22:
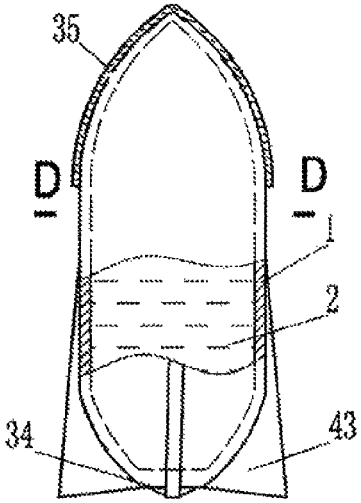
FIG. 22 is an eighth structural illustration of the liquid projecting bomb of the invention.
Figure 23:
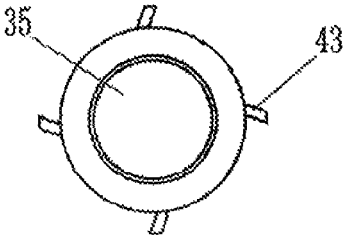
FIG. 23 is a top view of FIG. 22.
Figure 24:
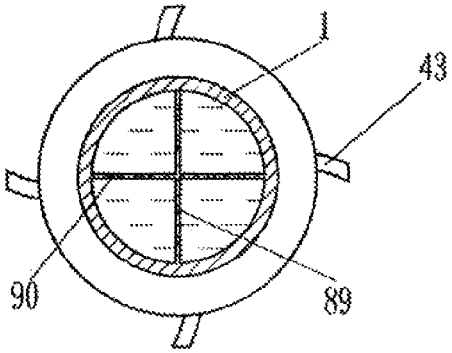
FIG. 24 is an enlarged sectional view of FIG. 22 taken along a line of D-D.

The liquid projecting bomb of the invention shown in FIGS. 22, 23, and 24 is different from that shown in FIG. 16 in that the stabilizing wings 43 are extended all the way to the middle of the shell 1. Moreover, the stabilizing wings 43 are arranged in spiral along the outer surface of the shell 1. A divider 89 that is integrally formed with the shell 1 inside the shell divides the space inside the shell into four chambers. The middle and lower portion of the divider 89 is provided with a plurality of holes 90 that makes the four chambers in communication with one another.

It should be noted that the stabilizing wings 43 in FIGS. 22, 23, and 24 are in open state in order for clear illustration of structures of various portions of the liquid projecting bombs of the present invention. In practical applications, the stabilizing wings 43 that are made of paper cardboard are closely adhered to the outer surface of the shell 1 and open only when they are flying in rotation, as shown in the drawings. Moreover, purpose of providing the divider 89 is to prevent the liquid inside the shell from not rotating with the shell due to its inertia during flying in rotation after the liquid projecting bomb is projected out. Because of existence of the divider 89, it is possible to push the functional liquid inside the shell to rotate with the shell together during the flying of the liquid projecting bomb and, thus, provide a more stable flying. Besides, since the divider 89 divides the space within the shell into four chambers, in order to prevent a situation that quantity of the functional liquid in each chamber is different during process of filling the functional liquid into the shell, the lower and middle portions of the divider 89 are provided with a plurality of holes 90 that makes the four chambers in communication with each other to ensure an even distribution of the functional liquid among the four chambers. Of course, this embodiment is illustrated by the situation in which the divider 89 divides the space within the shell into four chambers. In practical applications, it is also possible that the space is divided into two, three, or more than four chambers, they all being capable of realizing the same effect. However, for making the process of filling functional liquid convenient, it would be better not to have too many chambers. Based on technical principle above, when there are fewer divided chambers (for example, two chambers), it is also possible to use two tubes to fill the functional liquid into the chambers separately in order to speed up the filling process and, thus not to have holes for communicating the chambers so that the two chambers are independent from each other. The solutions above are all simple derivatives of the principle of this embodiment and, thus are within the claimed protection scope of the invention.

Figure 25:
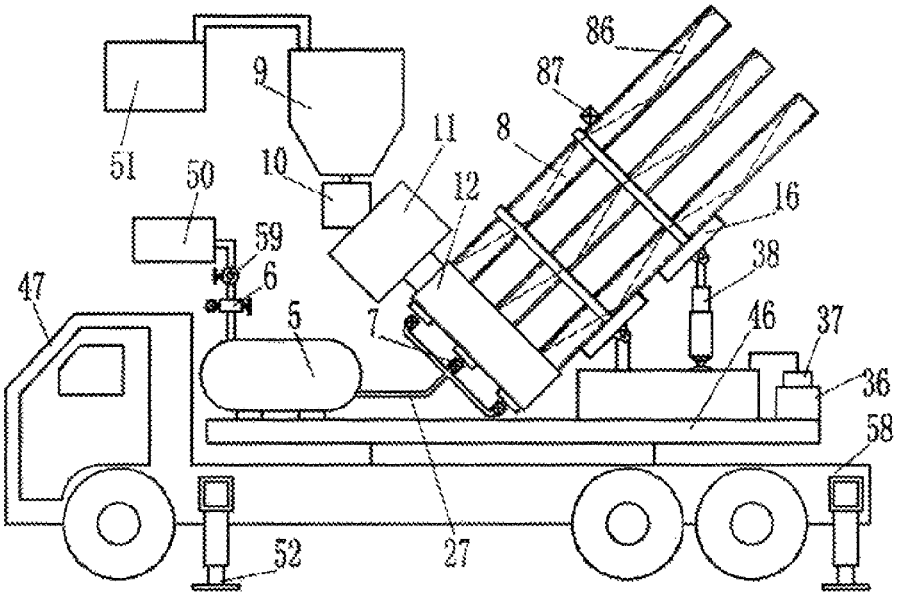
FIG. 25 is a seventh structural illustration of the projecting device of the invention.

In order to facilitate applications of the liquid projecting bomb shown in FIGS. 22, 23, and 24, the projecting device of the invention shown in FIG. 25 is provided with a spiral smoothbore channel 86 on the inner surface of the chamber of the projecting barrel 8, which is different from the projecting device shown in FIG. 17. Surface of the spiral smoothbore channel 86 is smooth and rounded in order to prevent it from scratching the shell. By this way, the liquid projecting bomb has capability of rotating, and a more stable flying attitude when it is projected out of the barrel. Also, the projecting barrel 8 is provided with a pressure-relief valve 87 instead of the structure of the enlarged section with a cone angle inside the front of projecting barrel of the projecting device shown in FIG. 17. It follows technical principle that when the liquid projecting bomb is about to be projected out of the projecting barrel, the pressure-relief valve 87 is actuated and releases the projecting pressure at the tail end of the liquid projecting bomb. The liquid projecting bomb is thus projected with its inertia. When the liquid projecting bomb leaves the projecting barrel, pressure difference between the front end and the tail end can be withstood by the shell of the bomb. As such, problem of bursting of the shell due to a large pressure difference between the bottom of the liquid projecting bomb that is under a high projecting pressure and the front that is under only the atmospheric pressure when the liquid projecting bomb is partially out of the projecting barrel can be effectively prevented.

Procedure of manufacturing and projecting of the liquid projecting bomb shown in FIGS. 22, 23, and 24 with the projecting device of this embodiment is the same as the procedure of manufacturing and projecting of the liquid projecting bomb shown in FIG. 16 with the projecting device shown in FIG. 17 and, thus is not repeated here.

The Twelfth Embodiment

Figure 26:
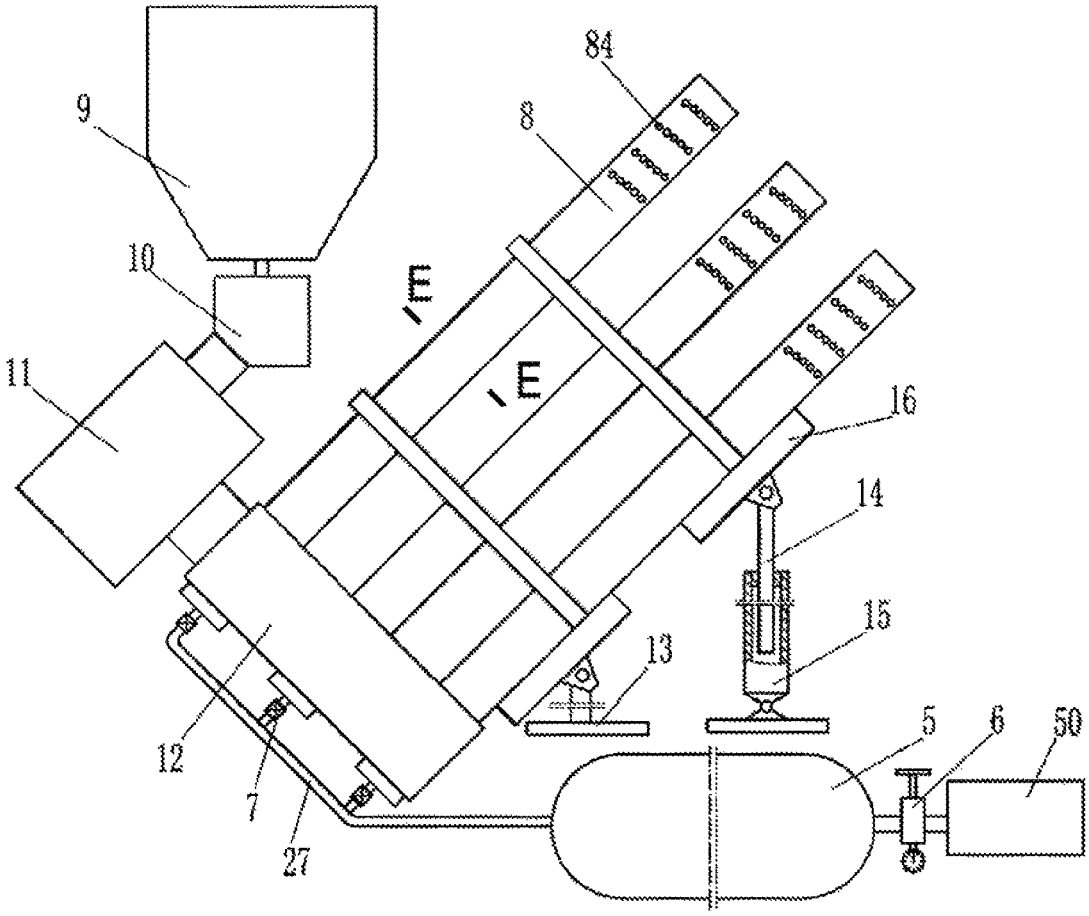
FIG. 26 is an eighth structural illustration of the projecting device of the invention.
Figure 27:
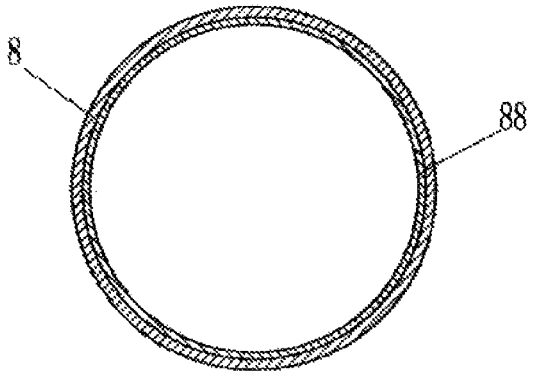
FIG. 27 is an enlarged view of FIG. 26 taken along a line of E-E.

The projecting device of the invention shown in FIGS. 26 and 27 is different from the projecting device shown in FIG. 3 in that a sleeve 88 that is made of a low friction coefficient material is provided in the chamber of the projecting barrel 8. The low friction coefficient material is PTFE in this embodiment.

Method of using the projecting device of this embodiment is identical to that of the projecting device of the first embodiment shown in FIG. 3 and, thus is not repeated here. Since the sleeve 88 is provided in the chamber of the projecting barrel, scratching of the shell due to roughness of the wall of the chamber of the projecting barrel during projecting can be prevented.

On basis of the technical principle above of this embodiment, other than providing the sleeve that is made of a low friction coefficient material in the chamber of the projecting barrel, it is also possible to provide a coating that is made of a low friction coefficient material. The low friction coefficient materials can be selected from a group consisting of nylon, PVC, fluorinated graphene, Teflon, or metallic materials that can be used in electroplating, which include zinc, nickel, chromium, and the like. All of them are capable of realizing the same effect and are described in text only, which are also within the claimed protection scope of the invention.

The Thirteenth Embodiment

Figure 28:
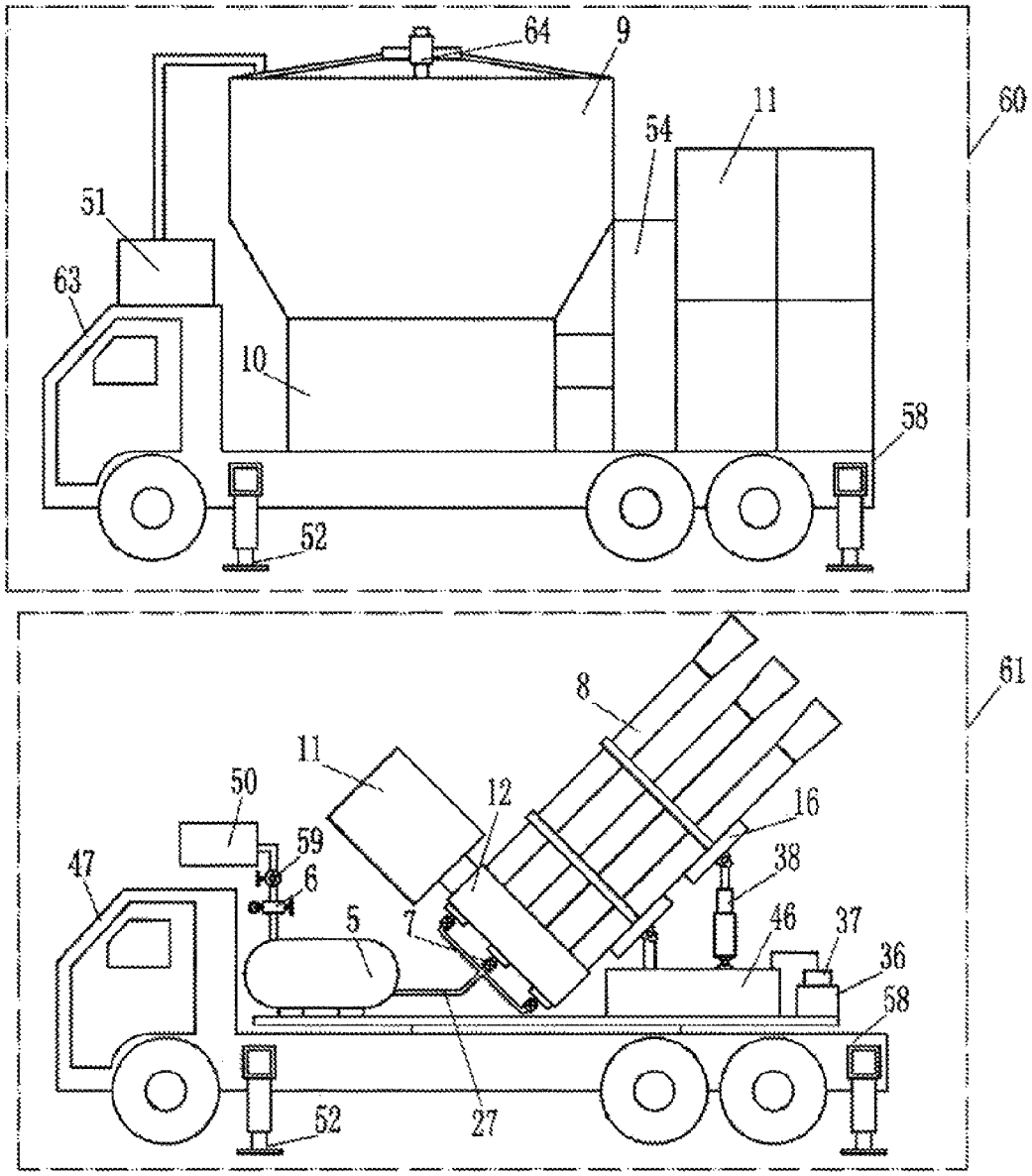
FIG. 28 is a ninth structural illustration of the projecting device of the invention.

The projecting device of the invention shown in FIG. 28 is different from that of the eighth embodiment in that a transportation station 54 is additionally provided between the bomb-packaging device 10 and the bomb storage 11 in the bomb-packaging truck 60.

When being used, it is different from that of the eighth embodiment in that when the bomb-packaging truck 60 manufactures the liquid projecting bomb, the bombs being made by the bomb-packaging device 10 are initially sent to the transportation station 54, where the liquid projecting bombs are put in the bomb storage 11 manually or by a stacking robot (not shown).

The Fourteenth Embodiment

Figure 29:
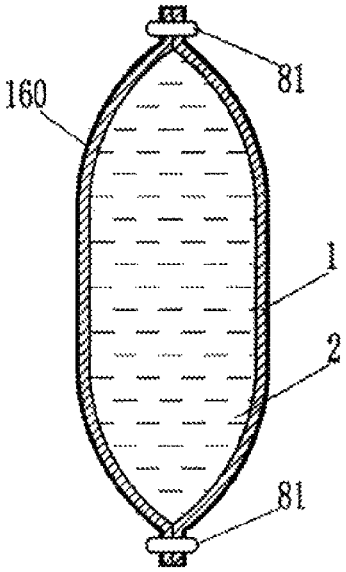
FIG. 29 is a ninth structural illustration of the liquid projecting bomb of the invention.

The liquid projecting bomb of the invention shown in FIG. 29 is different from the liquid projecting bomb shown in FIG. 1 in that both ends of the shell 1 is fastened by metallic clips 81. Moreover, the outer surface of the shell 1 is provided with a drag-reduction and abrasion-resistance layer 160. The drag-reduction and abrasion-resistance layer 160 is made of a low friction coefficient material. The low friction coefficient material is Teflon in this embodiment.

Since the outer surface of the shell 1 is provided with the drag-reduction and abrasion-resistance layer that is made of Teflon, it is possible to effectively prevent inadvertent damages of the shell due to friction between the liquid projecting bomb and the wall of the projecting barrel and, thus to improve reliability and delivery efficiency of deliveries. Moreover, since the drag-reduction and abrasion-resistance layer 160 plays the same role as the propelling mount of the first embodiment, the liquid projecting bomb of this embodiment is no longer provided with the propelling mount. In practical applications, it is possible to provide a drag-reduction and abrasion-resistance layer that is made of Teflon integrally on the surface of the plastic membrane of the shell 1 in advance, which is advantageous in simplifying structure of products and the manufacture process of the liquid projecting bombs, decreasing difficulties in manufacturing and transportation, and improving practicability of the products.

The Fifteenth Embodiment

Figure 30:
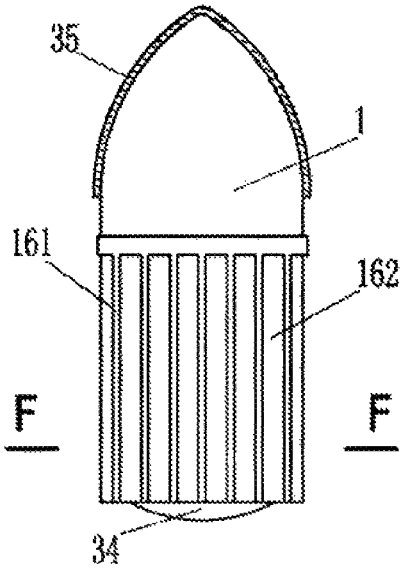
FIG. 30 is a tenth structural illustration of the liquid projecting bomb of the invention.
Figure 31:
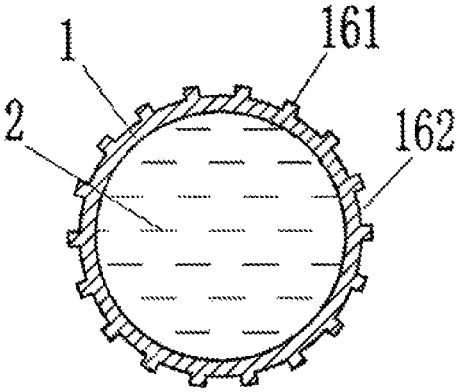
FIG. 31 is a sectional view of FIG. 30 taken along a line of F-F.

The liquid projecting bomb of the invention shown in FIGS. 30 and 31 is different from that shown in FIG. 12 in that the outer surface of the shell 1 is further provided with a pressure-balancing channel. The pressure-balancing channel is surrounded by projections 161 integrally formed on the surface of the shell, and is provided with an opening towards the tail of the shell 1.

Due to arrangement of the pressure-balancing channels 162 on the outer surface of the shell 1, when the liquid projecting bomb of the invention is loaded into the projecting barrel and after the projections 161 come into contact with the wall of the projecting barrel, the pressure-balancing channel and the wall of the barrel form an air chamber that is in communication with the projecting chamber. When the liquid projecting bomb is moving along the projecting chamber under air pressure, contact area of the air chamber between the liquid projecting bomb and the wall of the projecting barrel decreases, and air within the air chamber further plays a role of smoothing, which effectively prevents premature dispersal of the functional liquid inside the shell due to inadvertently damaging of the liquid projecting bomb and thus improves reliability and efficiency of deliveries.

The Sixteenth Embodiment

Figure 32:
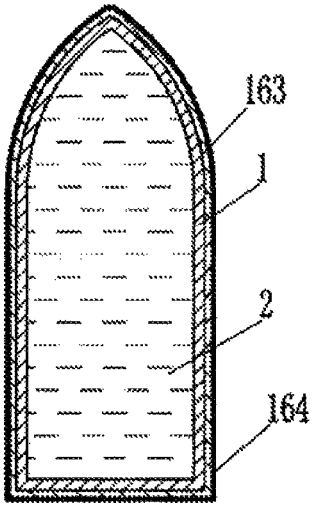
FIG. 32 is an eleventh structural illustration of the liquid projecting bomb of the invention.

The liquid projecting bomb of the invention shown in FIG. 32 is different from the liquid projecting bomb shown in FIG. 1 in that the outer surface of the shell 1 is provided with a propelling casing 163. Surface of the propelling casing 163 is further provided with a drag-reduction and abrasion-resistance layer 164 that is made of a low friction coefficient material. The material is nylon in this embodiment.

Since the outer surface of the shell 1 is provided with the drag-reduction and abrasion-resistance layer 164 that is made of nylon, it is possible to effectively prevent inadvertent damages of the shell due to friction between the liquid projecting bomb and the wall of the projecting barrel and, thus to improve reliability and efficiency of deliveries.

The Seventeenth Embodiment

Figure 33:
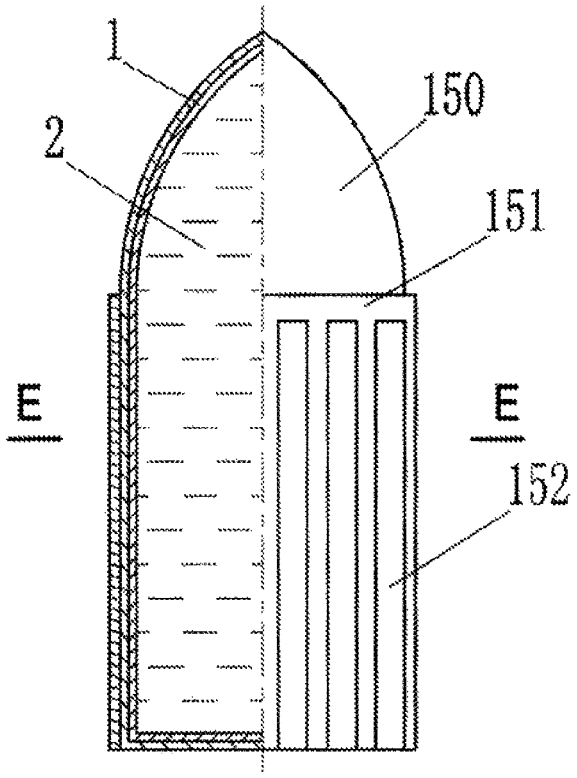
FIG. 33 is a twelfth structural illustration of the liquid projecting bomb of the invention.
Figure 34:
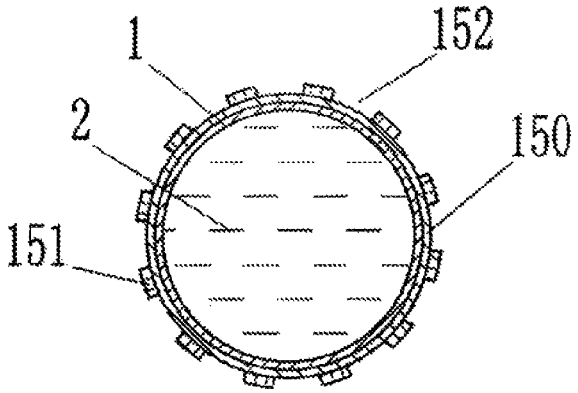
FIG. 34 is a sectional view of FIG. 33 taken along a line of E-E.

The liquid projecting bomb of the invention shown in FIGS. 33 and 34 still uses water 2 as the functional liquid. It is different from the liquid projecting bomb shown in FIG. 1 in that both ends of the shell 1 that is made of a plastic membrane are sealed by heat-sealing process. Moreover, the outer surface of the shell is partially provided by nesting with a propelling casing, the propelling casing including a friction-protective shell 150 and a lubrication-protective shell 151. The lubrication-protective shell 151 is fixed on outer surface of the friction-protective shell 150 and is provided with multiple pressure-balancing channels 152. Each of the pressure-balancing channels 152 is provided with an opening towards the tail of the shell. Both the friction-protective shell 150 and the lubrication-protective shell 151 are made of hard paper cardboard, and the lubrication-protective shell 151 and the friction-protective shell 150 are bonded to each other.

Compared to the first embodiment, both ends of the shell 1 of the liquid projecting bomb of this embodiment are sealed by heat-sealing process, and the projecting procedure of this embodiment is substantially the same as that of the first embodiment, which is not repeated herein. Moreover, similar to the principle described in the fifteenth embodiment, since the outside of the shell 1 is provided with the propelling casing consisting of the friction-protective shell 150 and the lubrication-protective shell 151 and the outer surface of the lubrication-protective shell 151 is further provided with the pressure-balancing channels 152, when the liquid projecting bomb of the invention is loaded into the projecting barrel and after the projections around the pressure-balancing channels 152 come into contact with the wall of the projecting barrel, the pressure-balancing channels together with the wall of the barrel form air chambers that are in communication with the projecting chamber. Also, since there is no contact between the shell 1 and the inner wall of the projecting barrel during projecting, when the liquid projecting bomb moves along the projecting chamber under air pressure, the contact area of the air chambers between the liquid projecting bomb and the wall of the projecting barrel decreases, and the air within the air chamber further plays a role of smoothing, which effectively prevents premature dispersal of the functional liquid inside the shell due to inadvertently damaging of the liquid projecting bomb and thus improves reliability and efficiency of deliveries.

To sum up, the liquid projecting bombs of this embodiment have a lower delivery loss rate, better delivery effect, and are more reliable, efficient, and practical. According to the principles described in the sixteenth and seventeenth embodiments, the propelling casing of the liquid projecting bomb of the invention has various structures and various ways to configure. For example, the propelling casing can be arranged at the bottom and partially on the side of the shell, or at the bottom and the whole side of the shell. In an application, selection can be made according to practical demands.

The functional liquid of the liquid projecting bomb of the invention mainly is water, which is readily accessible. The shell can be made of various materials including soft or hard materials that are easy to crack when bumped. The soft material that is easy to crack when bumped comprises plastic membranes, foils, papers, or composites that are made of at least two of them. The hard material that is easy to crack when bumped comprises hard papers, plastic, or composites of the two. The shell of the liquid projecting bomb of any one of the embodiments of the invention can choose a material among those two kinds of materials mentioned above according to demands. The materials mentioned above are readily accessible and are advantageous in lowering cost. Since the projecting device of the invention is capable of realizing the whole procedure of manufacturing and projecting of the liquid projecting bombs, problems that the traditional fire-extinguishing bombs need to be manufactured and stored in advance, and more room for occupancy is needed, risks of being ineffective due to expiration occurs if the bombs are preserved for long-term are prevented, and a problem that supply and transportation of bombs cannot be met when high volume of projecting are projected during field work can be solved. Thus, the projecting device of the invention is safe, efficient, and environmentally friendly and is of high volume of projecting. Its economic efficiency, adaptability, and practicability are improved substantially. It should be noted that based on the delivery principles described in this invention, the projecting device of the invention can also be used in delivering articles for daily uses and protections to disaster areas where traffic is blocked, so as to improve capability of aid and, thus is also within the claimed protection scope of the invention. Furthermore, the present invention is not limited to the described applications above. Based on the principles described herein, relevant solutions can be cross-referenced and, thus are within the claimed protection scope of the invention.

What is claimed is:

1. A projecting device for projecting liquid projecting bombs each including a shell filled with functional liquid and made of soft or hard material being easy to crack when bumped, comprising:

a compressed air source, a projecting switch, a projecting barrel with a projecting chamber provided at a tail of the projecting barrel, a functional liquid source, a bomb-packaging device, a bomb storage, a bomb-loading device, and an accumulator-regulating tank, wherein the functional liquid source is configured to provide the functional liquid, the bomb-packaging device is configured to pack the functional liquid from the functional liquid source so as to form the liquid projecting bombs, the packed liquid projecting bombs are stored within the bomb storage, and the accumulator-regulating tank is provided with a pressure-regulating device and is in communication with the projecting chamber via the projecting switch.

2. The projecting device in accordance with claim 1, wherein more than one projecting barrel is provided and all the projecting barrels are arranged in one row, two rows, or more than two rows, constituting one or more groups of projecting barrels.

3. The projecting device in accordance with claim 2, wherein the projecting barrels are divided into at least two groups, wherein each group includes at least one projecting barrel and shares one projecting switch, a delay switch-on mechanism is provided between two projecting switches of the groups adjacent to each other, and wherein each projecting switch is provided with an automatically switch-off mechanism, and one of the automatically switch-off mechanisms coordinates with a next one of the switch-on mechanisms.

4. The projecting device in accordance with claim 1, wherein the projecting barrel has an inner surface provided with a gradually spiral smoothbore channel, and all concave or convex surfaces of the smoothbore channel are smooth and rounded.

5. The projecting device in accordance with claim 1, wherein a sleeve or a coating film is provided inside of the projecting chamber of the projecting barrel and made of low friction coefficient materials, wherein the low friction coefficient materials include nylon, PVC, fluorinated graphene, Teflon, or metallic materials usable in electroplating.

6. The projecting device in accordance with claim 1, wherein a pressure-relief device is provided on the projecting barrel.

7. The projecting device in accordance with claim 6, wherein the pressure-relief device is a pressure-relief valve arranged on the projecting barrel, an enlarged section near an outlet end of the projecting barrel, wherein the enlarged section has an inner diameter increasing gradually from an inner end toward an outer end, or a pressure-relief section near an outlet end of the projecting barrel, wherein the pressure-relief section has a wall provided with a plurality of pressure-relief holes, and has a length longer than that of at least one of the liquid projecting bombs.

8. The projecting device in accordance with claim 1, wherein a propelling mount barrel and a propelling mount barrel restoring mechanism are provided within the projecting chamber of the projecting barrel, and wherein the liquid projecting bombs are loaded within the propelling mount barrel when being projected.

9. The projecting device in accordance with claim 1, wherein a sensing and actuating mechanism for the liquid projecting bombs leaving the barrel is provided at a front of the projecting barrel, wherein the projecting switch is provided with an automatically switch-off mechanism, and the sensing and actuating mechanism for the liquid projecting bombs leaving the barrel includes a photoelectric sensor or a pressure sensor and configured to actuate the automatically switch-off mechanism to switch off the projecting switch, and/or to actuate the bomb-loading device to open the projecting chamber.

10. The projecting device in accordance with claim 1, wherein a sighting system is provided on the projecting barrel, wherein the sighting system comprises at least one of a laser rangefinder, an optical sight, an elevation angle measurement device, a rotational angle measurement device, and an angle-regulating device and/or an elevation-regulating device.

11. The projecting device in accordance with claim 10, wherein the sighting system further comprises a meteorological sensing system and a trajectory calculation system, wherein the meteorological sensing system includes at least one of an anemometer, an anemoscope, barometer, and a thermometer, and measurement results of the meteorological sensing system are input into the trajectory calculation system to calculate projecting pressure and sighting parameters of groups of the projecting barrels.

12. The projecting device in accordance with claim 11, wherein the pressure-regulating device comprises a pressure sensor and a pressure-regulating valve that are communicated with the accumulator-regulating tank, and the pressure-regulating valve includes three functional valves or three valve statuses: switching off, depressurizing, and pressurizing.

13. The projecting device in accordance with claim 1, wherein the bomb-packaging device comprises a feeding tube, a feeding switch, a metering device, a shell holding device, a shell-opening device, and a shell-closing device.

14. The projecting device in accordance with claim 13, wherein the bomb packaging device further comprises a vacuum-sorbing device.

15. The projecting device in accordance with claim 1, wherein the accumulator-regulating tank is connected with the compressed air source, and the pressure-regulating device is provided between the accumulator-regulating tank and the compressed air source.

16. The projecting device in accordance with claim 1, further comprising a rotary chassis, a fixed chassis, and a truck, wherein the rotary chassis is configured to rotate relative to the fixed chassis, at least the bomb-loading device, the projecting barrel, and the accumulator-regulating tank are placed on the rotary chassis, and the fixed chassis is fixed to the truck, the truck constitutes a projecting truck, and the projecting truck is provided with hydraulic stabilizing legs.

17. The projecting device in accordance with claim 1, wherein the functional liquid source, the bomb-packaging device, and the bomb storage are provided on a truck, the truck constitutes a bomb-packaging truck, and the liquid projecting bombs that are prepacked are stored within the bomb storage.

18. The projecting device in accordance with claim 1, further comprising a manual correction device or an automatic correction device for impact point.

19. The projecting device in accordance with claim 1, wherein the functional liquid source is a liquid storage tank and/or a liquid transportation pump.

20. The projecting device in accordance with claim 19, wherein a stirring device is provided in the liquid storage tank.

21. A method of delivering the liquid projecting bombs with a projecting device, each of the liquid projecting bombs including a shell filled with functional liquid and made of soft or hard material being easy to crack when bumped, and the projecting device including a compressed air source, a projecting switch, a projecting barrel with a projecting chamber provided at a tail of the projecting barrel, a functional liquid source configured to provide the functional liquid, a bomb-packaging device configured to pack the functional liquid from the functional liquid source so as to form the liquid projecting bombs, a bomb storage configured to store the liquid projecting bombs packed by the bomb-packaging device, a bomb-loading device, and an accumulator-regulating tank provided with a pressure-regulating device and in communication with the projecting chamber via the projecting switch, said method comprising the steps of:

packing the functional liquid from the functional liquid source into the shells by the bomb-packaging device to prepare the liquid projecting bombs;

storing the liquid projecting bombs within the bomb storage;

stably placing the projecting device near a target according to a working range;

loading the liquid projecting bombs in the bomb storage into the projecting chamber of the projecting barrel by the bomb-loading device, closing the projecting chamber;

determining projecting parameters, and aiming at the target;

finely-tuning pressure in the accumulator-regulating tank by the pressure-regulating device according to the projecting parameters, so that the pressure in the accumulator-regulating tank reaches a set projecting pressure;

switching on the projecting switch so that the accumulator-regulating tank is in communication with the projecting chamber, and the compressed air in the accumulator-regulating tank enters into the projecting chamber to push at least one of the liquid projecting bombs in the projecting chamber out of the projecting barrel, then switching off the projecting switch at the moment when the at least one of the liquid projecting bombs is about to be projected out of the projecting barrel;

correcting horizontal angle, elevation angle, or projecting pressure of the projecting barrel during projecting according to actual impact point; and reloading the liquid projecting bombs for a next round of projecting into the projecting barrel by the bomb-loading device to undertake the next round of projecting.

22. The method in accordance with claim 21, wherein when more than one projecting barrel is provided, delay switch-on mechanisms and automatically switch-off mechanisms of various projecting switches of various projecting barrel groups cooperate with each other to accomplish each one of the various projecting barrel groups projecting the liquid projecting bombs successively.

* * * * *